US008590266B2

(12) United States Patent
Young

(10) Patent No.: US 8,590,266 B2
(45) Date of Patent: Nov. 26, 2013

(54) MACHINE AND METHOD FOR INSTALLING CURVED HARDWOOD FLOORING

(76) Inventor: Julius Young, Sarasota, FL (US)

( * ) Notice: Subject to any disclaimer, the term of this patent is extended or adjusted under 35 U.S.C. 154(b) by 289 days.

(21) Appl. No.: 12/982,892

(22) Filed: Dec. 31, 2010

(65) Prior Publication Data

US 2012/0000159 A1 Jan. 5, 2012

Related U.S. Application Data

(62) Division of application No. 11/675,225, filed on Feb. 15, 2007, now Pat. No. 7,886,785.

(51) Int. Cl.
*E04B 1/00* (2006.01)

(52) U.S. Cl.
USPC ..... 52/745.2; 52/747.1

(58) Field of Classification Search
USPC ..... 52/127.5, 741.1, 745.19, 745.2, 747.1, 52/747.11
See application file for complete search history.

(56) References Cited

U.S. PATENT DOCUMENTS

| | | | | | |
|---|---|---|---|---|---|
| 1,094,449 | A | * | 4/1914 | Lauri | 254/13 |
| 1,133,174 | A | | 3/1915 | Orm | |
| 1,906,392 | A | | 11/1930 | McLeod | |
| 1,862,414 | A | | 6/1931 | Mc Alaster | |
| 2,399,348 | A | | 3/1943 | Hobbs | |
| 2,710,166 | A | * | 6/1955 | Miller | 254/11 |
| 3,107,708 | A | | 10/1963 | Savage | |
| 3,143,335 | A | * | 8/1964 | Lassahn | 254/11 |
| 3,660,894 | A | * | 5/1972 | Sand | 30/74 |
| 4,711,281 | A | * | 12/1987 | Kessel et al. | 144/256.1 |
| 4,793,392 | A | | 12/1988 | Gauld | |
| 4,909,889 | A | | 3/1990 | Stroxler | |
| 5,134,907 | A | | 8/1992 | Branson | |
| 5,199,475 | A | * | 4/1993 | Koeder | 144/256.1 |
| 5,203,948 | A | | 4/1993 | Suska | |
| 5,214,951 | A | | 6/1993 | Waddell | |
| 5,456,053 | A | | 10/1995 | Fischer | |
| 5,788,221 | A | * | 8/1998 | Muhlebach et al. | 254/16 |
| 5,894,705 | A | | 4/1999 | Sutton | |
| 5,946,785 | A | * | 9/1999 | Muhlebach et al. | 29/281.1 |
| 5,964,450 | A | | 10/1999 | Pasto | |
| 6,330,894 | B1 | | 12/2001 | Austin | |
| 6,370,836 | B1 | | 4/2002 | Gunn | |
| 6,571,841 | B1 | | 6/2003 | Patton | |
| 6,615,553 | B2 | | 9/2003 | Omundson | |
| 6,616,132 | B1 | * | 9/2003 | Ellison | 269/15 |
| 6,669,173 | B1 | * | 12/2003 | Dunn | 254/201 |

* cited by examiner

*Primary Examiner* — Jessica Laux

(57) ABSTRACT

The present invention relates to the art of installing hardwood flooring while maintaining the wood grain in the direction of any bends required to conform to a curved structure. More particularly, the invention pertains to a machine and method for installing curved hardwood flooring using three steps. First step is to establish the desired floor boundary and anchor a plurality of pressure units in place at appropriate intervals to accurately represent the desired shape of the curved hardwood floor to be installed. Second step is to make appropriate adjustments to the pressure units and position the hardwood flooring in the machine; Third step is to activate the pressure units to bend the flooring into the desired contour; hold securely; make adjustments, if necessary and nail the hardwood flooring to the sub-floor. Then repeat steps 2 and 3 until the hardwood floor is completed.

8 Claims, 15 Drawing Sheets

MACHINE AND METHOD FOR INSTALLING CURVED HARDWOOD FLOORING

CROSS REFERENCE TO RELATED APPLICATIONS

This is a divisional application of a co-pending U.S. patent application Ser. No. 11/675,225, filed Feb. 15, 2007, incorporated by reference herein.

FIELD OF THE INVENTION

The present invention relates to the bending of elongated material (examples are elongated corrugated metals, thin walled materials, wooden planks, thin wooden slats, etc.) to conform to a predefined contour or shape; specifically the present invention relates to the art of bending wood to conform to a curved structure and permanently securing it in place while maintaining the wood grain in the direction of any bends required. More specifically, the invention pertains to a machine and method for installing curved hardwood flooring to conform to a predefined contour along the floor.

BACKGROUND OF THE INVENTION

Discussion of Prior Art

Hardwood flooring is usually supplied as straight boards having a tongue along one side edge and groove along the opposite side edge such that the tongue of one floor board fits into the groove in the adjacent floor board. Each floor board also has a tongue at one end and groove at the opposite end. This allows boards to be placed end to end as well as side to side, thus making a floor of specified length and width. Typical installation consists of ¾" depth Oak Boards of 2¼" width and varying lengths, with a first set of boards installed along a wall (with a ¾" expansion space between the wall and the first row of boards and usually with the tongue facing away from the wall) or some other predetermined straight demarcation. Then securing them in place by face-nailing them at 12" intervals about ½" from the edge closest to the wall and also nailing each at roughly a 45 degree angle, at intervals of 8" to 10" through the tongue and into the sub-flooring (frequently ¾ Plywood nailed to the floor joists). The next row of boards are then abutted next to the first row of boards with the tongue of the first row of floor boards fitting into the grove of the second row of floor boards abutting it. Thus securing the back of the board, which is further secured by nailing through the tongue and into the sub-floor as described above. Note that the second and subsequent rows of boards are not face-nailed. Each succeeding row of boards is installed as described for the second row of boards, until the entire floor is installed. Typically, the first few rows must be edge-nailed (i.e. nailed at 45 degrees through the tongue and into the sub-floor) by hand due to a vertical wall or other obstruction. When clearance allows, an edge-nailing machine can be used to simplify and speed up the nailing process. The typical hardwood floor installation described above and associated tools, work when the room and/or the area of floor to be covered is square, rectangular or consists of boundaries that are essentially straight lines. The use of such machines and methods become impractical if one wishes to install curved floors.

The prior art contains machines and processes that can be used to install floor boards. These fall roughly into two categories. The process outlined for machines that fall into the first category (disclosed in U.S. Pat. Nos. 6,615,553; 5,456,053) requires that such a machine be clamped to the floor joists to anchor it so that it can force the boards together. This sometimes works for new construction when the floor boards are being installed directly over the joists but more often than not there is another material (usually ¾" plywood sub-floor) nailed to the joists for added strength and stability, before the final floor is laid. In such situations as well as for existing construction, the floor joists are not accessible. As for machines that fall under the second category (disclosed in U.S. Pat. Nos. 6,370,836; 5,964,450; 5,894,705; 5,134,907), these machines can be anchored directly to the sub-floor or braced against a structure. Both categories of machines and their methods were designed to install floor boards in areas that have walls or other barriers that are relatively straight. Neither category of machines and associated methods is adequate to handle those situations where the boundaries of the existing floor area or the walls of the room have curves or a contour that, in general, are not straight. Therefore, there is a need for a machine and method for installing hardwood flooring that conforms to the bends or curvature of the floor area or that follows the contour of the room that has walls that in general are not straight, regardless as to how the machine is anchored or braced.

When traditional hardwood floor installation techniques are planned for use in new construction, the creative initiative of architects and designers may be severely limited by the requirement to have walls and other boundaries that are straight. Alternatively, if one decides to have an odd shaped room or curved wall or structure, then the flooring materials used along such walls or structures must be easily shaped (i.e. such as carpet, tiles, etc.). Therefore, there is a need for a machine and method for installing hardwood flooring that can be easily shaped to conform to curved walls and other non-traditional contours. This would free the architects and designers to do more creative shapely designs and still install hardwood flooring right up to the structure.

In those cases where hardwood flooring is installed along a curved wall or some other predefined contour, it is usually a labor intensive process and is often done by 1) cutting the wood and piecing it together like a puzzle to conform to the desired contour; however the grain of the wood does not follow the contour; or in those rare cases where the grain of the wood must be maintained in the direction of the contour, it is often done by 2) introducing the additional steps of wetting the wood or using a machine to steam individual slats of wood to soften it while bending it to achieve the desired contour, restricting its movement while drying; and finally gluing the individually bent slats together, before or during their installation, to form standard width boards; however these additional steps dramatically slow down the installation time and adds labor costs. Thus, there is a need for a machine and a method for installing curved hardwood floors that would maintain the grain of the wood in the direction of the contour, does not require the extra steps of wetting or steaming the wood, is easy to use and does not increase the time and expense of the installation.

The art also contains machines and processes that are used to bend wood. However, they often target very narrowly defined functions such as bending wood to be used as the rounded sections of encasement windows (as disclosed in U.S. Pat. Nos. 6,571,841; 5,214,951; 5,203,948; 4,909,889; 4,711,281; 1,133,174), building structural members (as disclosed in U.S. Pat. Nos. 5,199,475; 2,399,348; 1,906,392), building the wooden rounded sections of a spiral staircase (as disclosed in U.S. Pat. Nos. 6,330,894; 4,793,392; 1,862,414) or building the rounded sections of specific furniture (as disclosed in U.S. Pat. Nos. 3,107,708; 22,529) for later assembly. These machines often include a large, heavy and expensive rig that is permanently setup at a factory or offsite location, where the product is made and assembled (with the wooden rounded section); then shipped and later installed in the final location. Generally, such machines are not portable and do not satisfy the need for a machine and a method for installing curved hardwood floors on site.

SUMMARY OF THE INVENTION

Given the inherent limitations of traditional methods and associated machines for installing hardwood flooring that conform to a predefined contour while maintaining the wood grain in the direction of any required bends, it is the object of the present invention to provide a method and machine that overcome the issues and limitations of the prior art.

The National Fluid Power Association, Inc. (NFPA) in one of its standards manuals (NFPA Recommended Standard NFPA/T3.6.64-1998, First Edition, 9 Apr. 1998) state that: Cylinders are used when linear force and motion are required. Cylinders are broken down into two main categories: pneumatic and hydraulic. Pneumatic cylinders can be operated by several types of gases; however, compressed air is by far the most common. Hydraulic cylinders can be operated with a very large range of fluids. By far the most common is petroleum based hydraulic fluid. Fire resistant fluids are also common. They may be synthetic or water based.

The present invention includes a plurality of pressure units (typically metal) adjustably anchored to a vertical structure or otherwise fixed in place at appropriate intervals to accurately represent the desired curvature of the hardwood floor to be installed around a curved structure. In order to install the first row of curved flooring, there would either be an existing boundary affixed to the sub-floor that follows a predefined shape or curved structure or such a boundary would be constructed, against which the first row of curved flooring would be abutted. Each subsequent row of curved flooring would abut the previous row.

There are at least 3 pressure units to accommodate a gradually changing, relatively short curve, but the total number will depend on how rapidly the curve is changing and on the width and relative length of hardwood slats used. The length of hardwood slats used is influenced by the linear footage of the perimeter of the curved section of floor being laid.

The hardwood slats are placed in the pressure units' pressure plates and bent into the shape of the desired curve by the strategically placed pressure units which can be powered by any one of several power systems (for example pneumatic, hydraulic or electric). When the pressure units are activated to install the first row of flooring, they collectively press the slats against a predefined boundary affixed to the sub-floor and in so doing, the slats of hardwood are bent into the desired contour, and then appropriately nailed or otherwise secured in place. Each subsequent row of flooring is then abutted to the previous row (which becomes the curved edge against which the next row of slats will be installed) using the same procedure and secured in place. This process is continued until the entire curved floor is installed.

If the length of the floor area to be covered by curved hardwood flooring is longer than the wood slats being used then the wood slats should be abutted to achieve the desired length, which is what is done when laying straight wood planks. Also if the floor length is more than 12 linear feet in length then perhaps it is better to install the floor in sections. This is because the lengths of hardwood slats used to cover the curved section of flooring are typically purchased in lengths of 8 to 12 feet for manageability of the project. It also allows for the installation of larger curved hardwood floor areas without a proportional increase in pressure units. For the sake of appearance, one should ensure that the sections interlock properly by using established techniques known by one skilled in the art of installing hardwood floors. Thus the ends of slats (properly grouped as explained below) should be staggered several inches in adjacent rows between sections to avoid clustering section end joints. If the plan is to match the appearance of the 2¼" traditional planks used elsewhere in the room, then perhaps a consideration should be given to installing the ¾" wide slats (with or without tongue and groove) one at a time; but grouped in sets of 3's so that the outside slats have beveled outside edges to imitate the beveled edges of traditional hardwood planks (with or without tongue and groove). A similar consideration could be made for other size planks (e.g. match 3" planks using ¾" wide slats grouped in sets of 4's).

Advantages of the Invention. One advantage of the machine and method of the present invention is that it can facilitate the installation of hardwood flooring in traditional installations as well as those situations where the room or area of floor to be covered has a nontraditional shape; that is, it is not square, not rectangular or where a substantial portion of its boundaries are not straight lines.

A further advantage of the invention is its flexibility in that the method and machine can be used in both new construction where the joists may be exposed and in existing construction where there usually is a sub-floor. In the former situation, the apparatus or machine can be anchored to the joists and used to install traditional hardwood flooring, if one wishes to install floor boards directly over the joists. In the later situation, the apparatus or machine can be attached to the sub-floor, braced against a wall or attached to some other fixed structure to perform its function. It could also be placed in a self contained machine housing.

An even further advantage of the present invention is that it allows architects and designers to plan for use of hardwood flooring right up to the walls in their designs without compromising their creative use of nontraditional shapes and structures in their designs.

Still another advantage is that it allows the installation of hardwood flooring that follows the contour of curved walls or other structures without the need for the labor intensive, time consuming steps of cutting the wood into small pieces and piecing it together like a puzzle to make it conform to a desired contour.

Another advantage of the present invention is that it eliminates the time consuming extra steps of steaming or soaking the wood to soften it before bending it, then restricting its movement to retain its shape while drying; in order to achieve the objective of maintaining the grain of the wood in the direction of the desired contour.

Another advantage of the present invention is that it can be used to install hardwood flooring "right up to" the ¾" expansion space many state and local building code and/or hardwood flooring manufacturers require between the finished floor and walls or other structures.

As for advantages related to the general use of the present invention to bend wood and other elongated materials to conform to a predefined contour or shape, the techniques employed by the present invention could improve the on site custom building of arched and curved building materials; such as trusts, windows, doors, etc. because the machine is portable. Usually such custom building is done off-site at a factory because the machinery to do such work is bulky, heavy, expensive and fixed in place.

Another area where the techniques of the present invention could be used is in on-site repair or custom building of the curved wood structures of boats, yachts, etc.

DETAILED DESCRIPTION OF THE FIRST EMBODIMENT OF THE INVENTION

Figure 1:
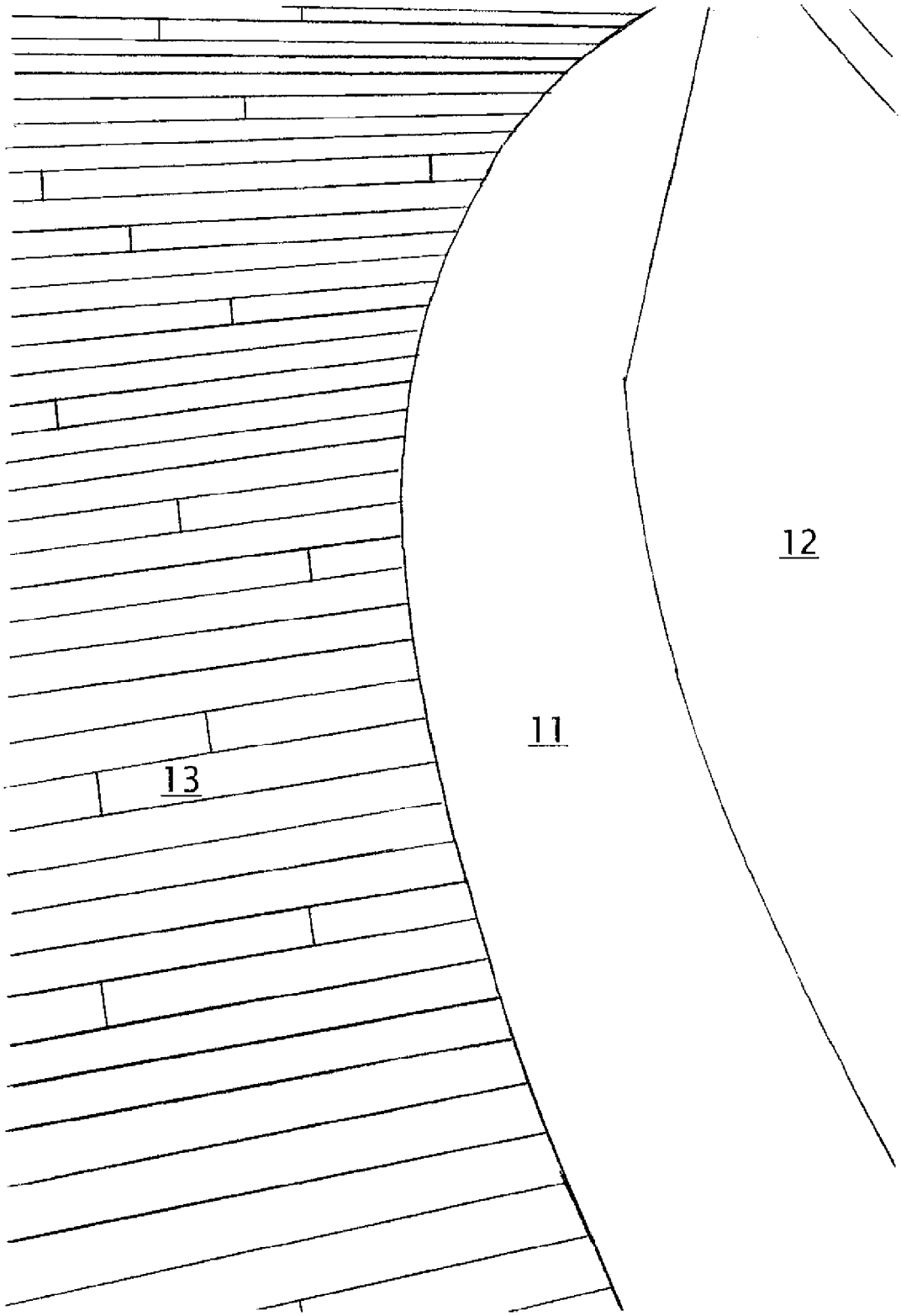
FIG. 1 shows a perspective view of a section of sub-flooring to be covered by curved hardwood flooring, bounded by curved structures.

Referring to the drawing figures listed above (designated FIGS. 1-10); the first embodiment of the present invention is an apparatus or machine comprising components which collectively work together to bend and install the wooden slats 101 to produce the desired curved hardwood floor installation. The first embodiment of the apparatus or machine of the present invention will be described initially and then the method of bending the wood to produce the curved hardwood floor will be described.

An apparatus or machine 10 (see FIGS. 2 and 3) of the present invention for installing curved hardwood flooring is positioned in the area of the floor to be covered (see FIG. 1), shown for illustrative purposes as comprising of a section of sub-floor 11 (just under 15" in width) and existing boundaries 12 and 13 (each with about a 45 linear foot; not all shown) affixed to the sub-floor, which follows a predefined shape or curved structure. The existing boundary 12 is shown to be a "low wall" on one side of the sub-floor 11 and the existing boundary 13 on the other side is traditional "hardwood flooring". If such boundaries are not in place then it would be constructed to create the desired curved shape.

Figure 2:
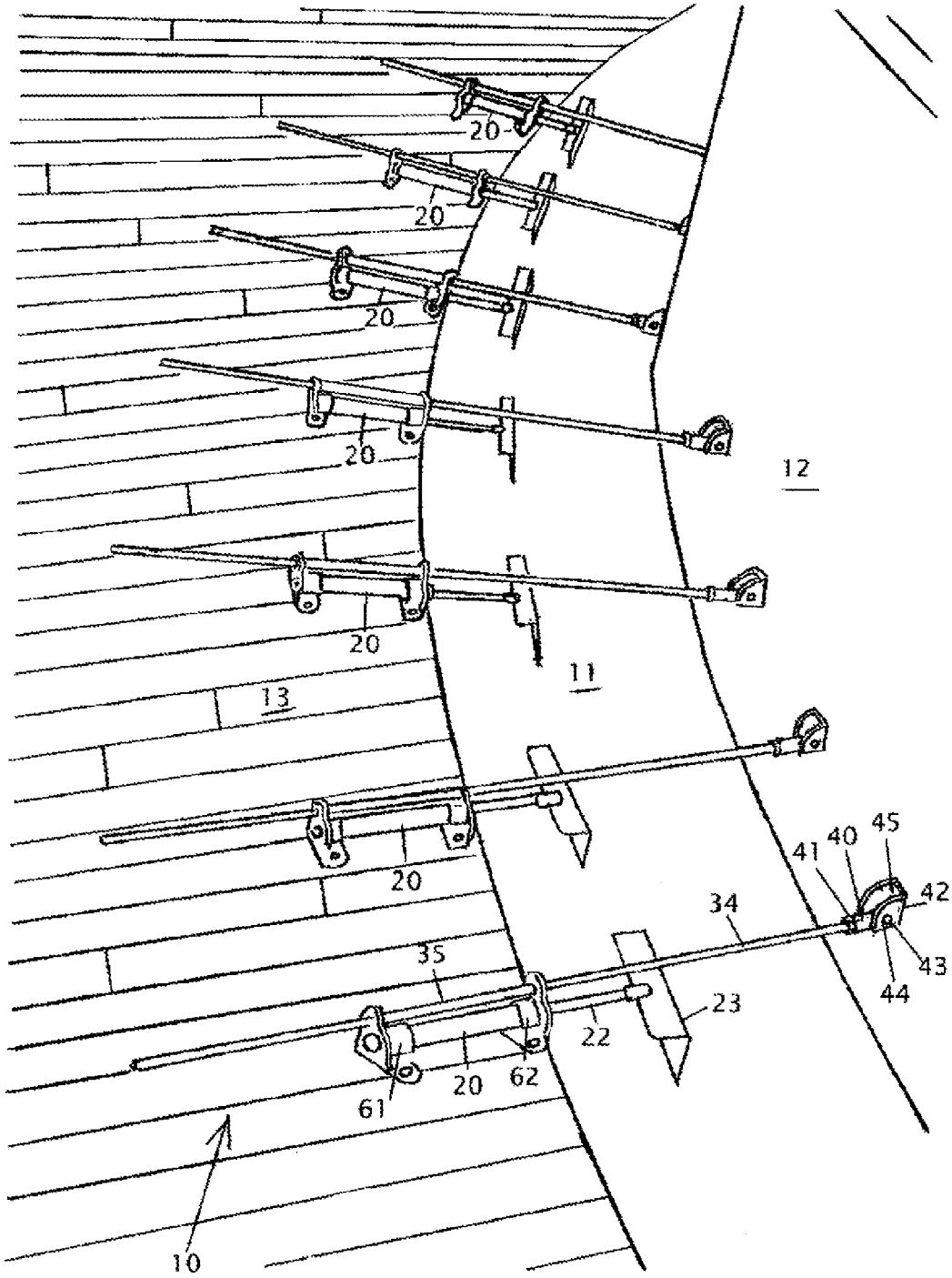
FIG. 2 shows a perspective view of a first embodiment of the present invention, implemented with a plurality of pressure units anchored to a curved low wall at appropriate intervals to accurately represent the desired curvature of the hardwood floor to be installed around the wall. The source of power for the pressure units is not shown in this view.
Figure 3:
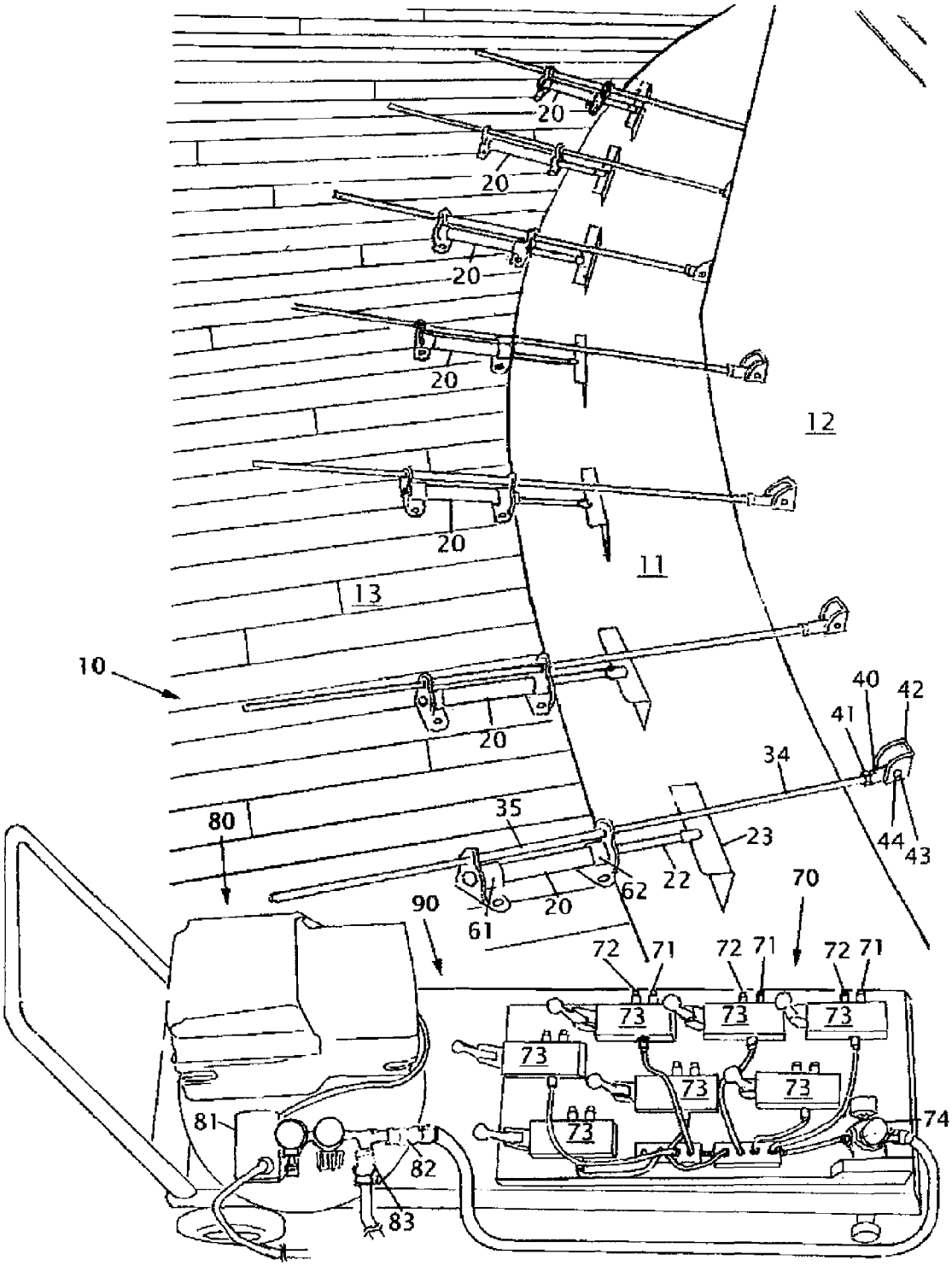
FIG. 3 is a perspective view similar to that of FIG. 2, showing a typical pneumatic circuit and compressor (familiar to one skilled in the art of using pneumatic tools and equipment) as the power source for the plurality of pressure units.
Figure 4:
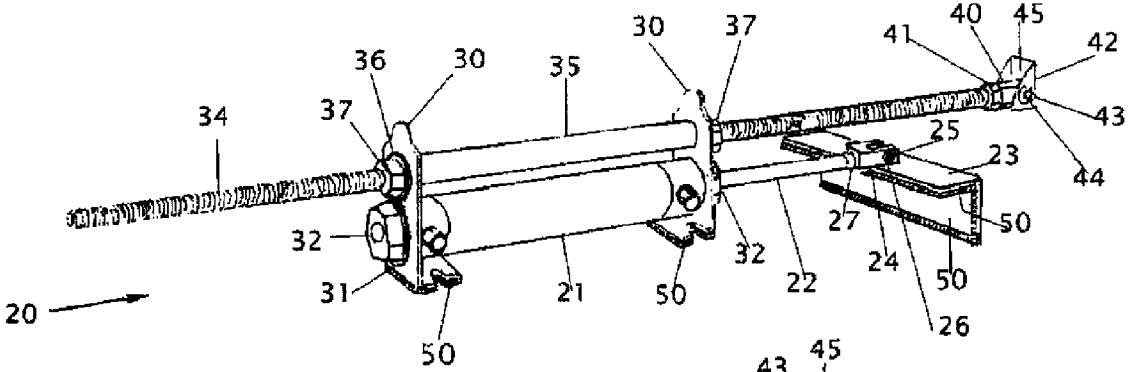
FIG. 4 is an enlarged side perspective view of a pressure unit of the apparatus shown in FIG. 2.
Figure 5:
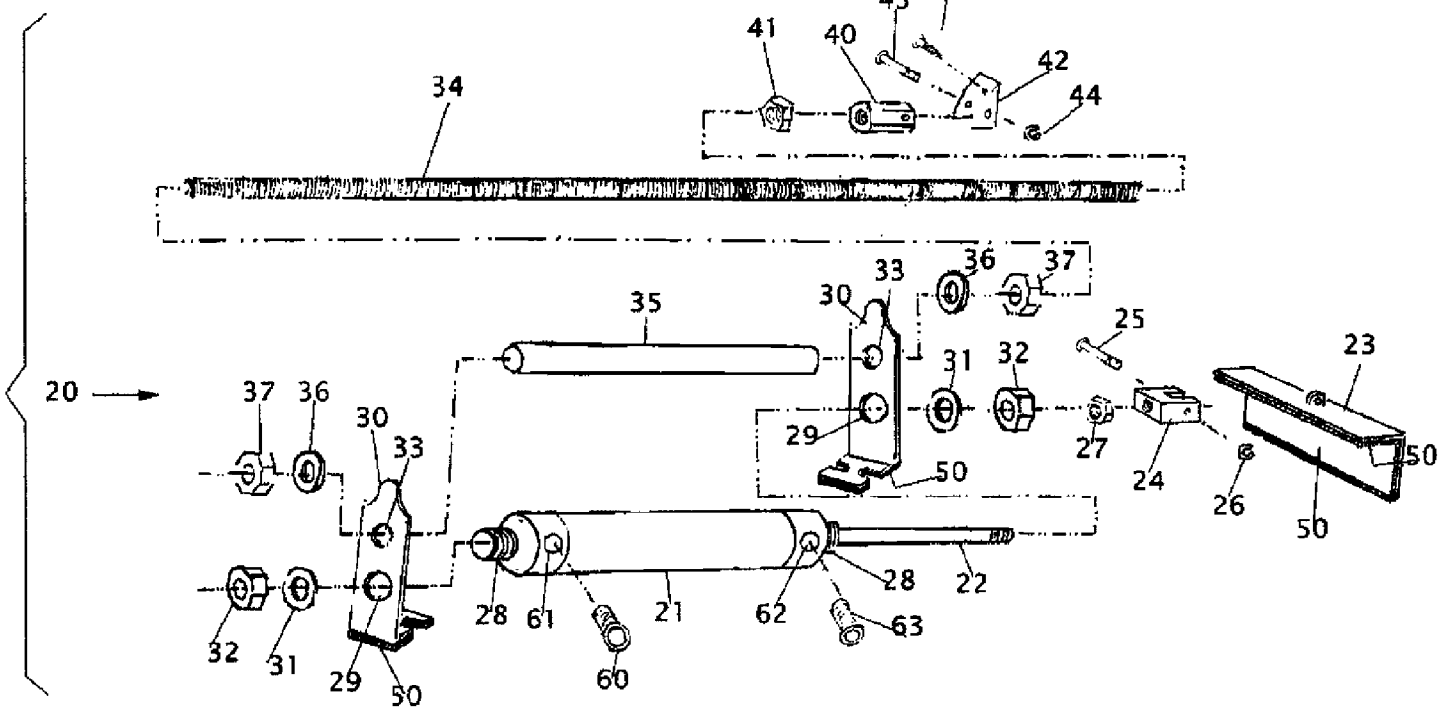
FIG. 5 shows an exploded View of the perspective view of FIG. 4. Various means of anchoring the pressure units are also shown in more detail.

The apparatus or machine 10 includes a plurality of pressure units 20, shown in FIGS. 2 and 3; and in more detail in FIGS. 4 and 5. All of the pressure units 20 are (usually but not necessarily) identical; however all pressure units 20 must be able to deliver the full range of pressure required for the desired curve and hardwood slats used. Each pressure unit 20 includes a double acting pneumatic cylinder 21 (typically metal, often stainless steel) having a bore size of 1 and 1/16", and a piston rod 22 with a 14" stroke; resulting in a pneumatic cylinder 21 with an overall length of about 31" (when fully extended). These metrics are nominal and the actual cylinder size used would depend on a number of technical factors such as the planned weight and size of the machine; the type and size of the slats or planks to be bent; the range of air pressure required for the job; the typical size floor one would expect to install and so on. For a given diameter bore, a manufacturer may offer a line of cylinders that has a very wide range of stroke sizes. For example, the cylinder used for illustrative purposes in this embodiment of the invention came from a line of stock cylinders that has a bore size of 1 and 1/16" and a stroke length that ranges from ½" to 32". With a 32" stroke, the cylinder would have a corresponding length (when fully extended) of over 5.5 feet. Also this same line of cylinders can be obtained in bore sizes of ½" to 3", each with a similar range of stroke lengths. The significance of this is that such cylinders can deliver a wide range of force (defined as the fluid pressure multiplied by the effective area of the piston). This line of cylinders has an maximum input pressure rating of 250 psi. For example a bore size of 3" yields an effective area multiply factor of approximately 7 and assuming an input pressure of 100 psi, the resultant delivered force would be 700 psi; while a bore size of land 1/16" yields an effective area multiply factor of approximately 0.9 resulting in a delivered force of 90 psi. This is enough force to simultaneously pull 3 slats 101 into the curved boundary 13 described in FIG. 1. Thus the techniques of this invention could be used with larger cylinders to bend a variety of elongated materials. Experience has shown that the cylinder size used for illustrative purposes in this embodiment of the invention is applicable across a wide range of curved hardwood floor installations; e.g. it would be applicable in a room with curved walls or structures but with areas similar in size to a 12'×12' room or a 20'×20' room, although if the majority of installations are in larger rooms (i.e. particularly width), one may have a personal preference for a pressure unit 20 with a longer reach (i.e. stroke length) to reduce the need to reposition the apparatus or machine because of the width of the floor area being laid.

As can be seen from the exploded view in FIG. 5, the pressure unit's 20 pneumatic cylinder 21 further includes a threaded mounting 28 at each of its ends to accommodate the lower holes 29 in mounting brackets 30, which are mounted at each end and secured by washers 31 and nuts 32.

Each pressure unit 20 also includes a pressure plate 23 (typically metal and/or structural plastic) attached to the threaded end of its piston rod 22 through a piston rod connector 24, which is secured by a clevis pin 25 and "c" clip 26 at the pressure plate 23 end and by screwing the piston rod connector 24 onto the threaded end of the piston rod 22, and secured with a locknut 27.

Figure 6:
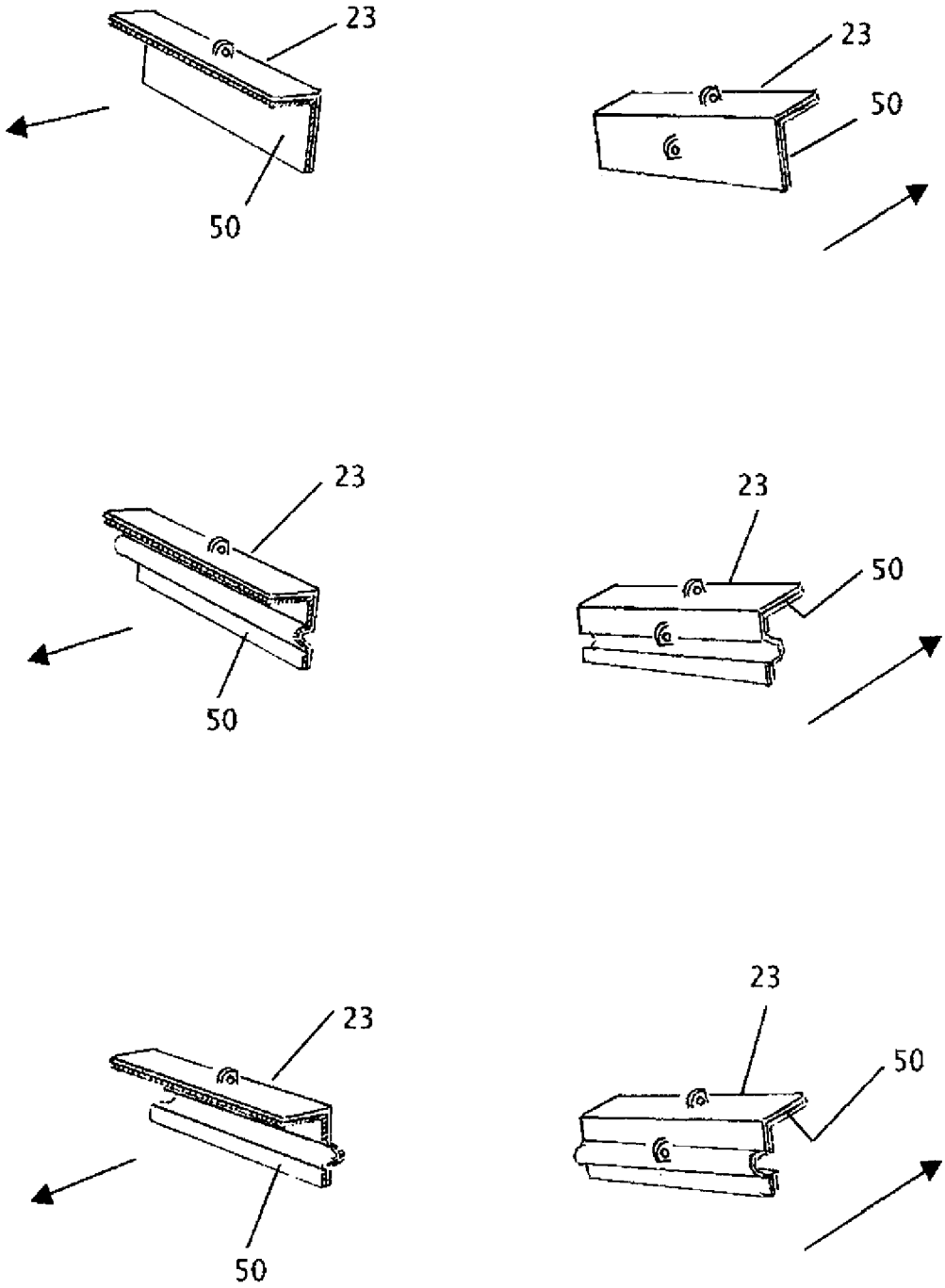
FIG. 6 shows a perspective view of various types of pressure plates for attachment to the pressure units.

The type of pressure plate 23 that is attached will depend on a number of factors including the type of slats 101 being installed (i.e. tongue and groove type or not), their size and whether they will be pulled into place or pushed into place. Referring to FIG. 6, the pressure plates 23 in column 1 are used to pull (see direction of the arrow) the hardwood flooring slats 101 (usually ¾" square by 8' to 12' long hardwood strips in groups of 3's to match 2¼" width traditional hardwood flooring planks) into place against the edge of the curved boundary 13. While those in column 2 are used to push (see direction of the arrow) the slats 101 into place. The pressure plates 23 in row 1 (i.e. plain pull pressure plate and plain push pressure plate in columns 1 and 2 respectively) are used for installing non-tongue and groove slats 101, which are then face-nailed. While those in row 2 (i.e. groove facing pull pressure plate and groove facing push pressure plate in columns 1 and 2 respectively) are for installing tongue and groove single slats 101 (i.e. when the groove is facing the pressure plate) and individually nailing them at a 45 degree angle in the groove into the sub-floor 11. Finally, those in row 3 (i.e. tongue facing pull pressure plate and tongue facing push pressure plate in columns 1 and 2 respectively) are for installing tongue and groove single slats 101 (i.e. when the tongue is facing the pressure plate) and individually nailing them at a 45 degree angle through the tongue into the sub-floor 11.

Note the attachment points at the back and top of the pressure plates 23 in column 2 which are used to properly connect the pneumatic cylinder 21 for pushing when the pneumatic cylinder 21 is sitting on the sub-floor 11 or finished floor 13 respectively. Also note that for ease of explanation both the pull pressure plates 23 in column 1 and the push pressure plates 23 in column 2 have been separately described. However the push pressure plates 23 in column 2 could also be used to pull slats 101 into place using the top attachment. Each pressure plate 23 (see FIGS. 4 and 5) also includes a scratch avoidance pad 50 attached to the surface of each pressure plate 23 wherever it is expected to come in contact with the hardwood flooring material. The same scratch avoidance pad 50 is attached to the bottom of each mounting bracket 30.

The actual dimensions of the pressure plate 23 should be consistent with the depth of the floor being installed, the type of pneumatic cylinder 21 used and whether the pressure units 20 are sitting on the finished floor 13 or the sub-floor 11. Thus (assuming 1 and 1/16" bore pneumatic cylinder 21) if the floor being installed is ¾" depth by 2¼" wide with the pressure units 20 on the finished floor, pulling slats 101 into the curved boundary, then a pressure plate 23 with a side view inverted "L" shape with vertical and horizontal dimensions of approximately 1½" by at least ¾" respectively measured from inside the scratch avoidance pad 50 area would be sufficient. As for the width of the pressure plate 23, it should be narrow enough to distribute the pressure plate 23 pressure along the slat 101 and allow the wood to bend and follow the intended radius of curvature but wide enough to avoid pin-point pressure that would be so great that it would cause the wood to break. Experience has shown that a pressure plate 23 width of 2" to 5" is adequate for radii of curvature of 6' to 12'.

Furthermore each pressure unit 20 includes a threaded anchor rod 34 which (for this embodiment) is usually two or more times the length of the pneumatic cylinder 21 (when extended), which passes through the top hole 33 of the back mounting bracket 30 and through the spacer tube 35 (which is equal to the length of the distance between the inside edge of the threads on the front threaded mounting 28 and the inside edge of the threads on the back threaded mounting 28 of the pneumatic cylinder 21), then passes through the top hole 33 of the front mounting bracket 30. The threaded anchor rod 34 and mounting brackets 30 that sandwiches the spacer tube 35 are held in place by washers 36 and the pressure unit's 20 longitudinal adjusting nuts 37.

Each pressure unit 20 can also be anchored in several ways. One anchoring technique #1 includes fastening the front of the threaded anchor rod 34 to a low wall 12 as shown in FIG. 2 or some other vertical structure through an anchor rod connector 40 screwed on its end, which is secured by a locknut 41, the anchor rod connector 40 in turn is attached to a pivot bracket 42, which is secured by carter pin 43 and "c" clip 44, which in turn is attached to the wall by a screw 45. Another anchoring technique #2 includes removably securing (via screws, nut and bolts, etc.) the pressure units 20 to a horizontal structure; e.g. the mounting brackets 30 to the sub-floor 11 or using floor anchors (not shown). The floor anchor would be attached to the front end of the threaded anchor rod 34 (if slats were to be pulled into position) or back end of the threaded anchor rod 34 (if slats were to be pushed into position); then removably attached to the sub-floor 11. Multiple floor anchors could be located anywhere along the rod if more than one were needed (i.e. a wide floor area being covered). Still another anchoring technique #3 is by securing the pressure units in a self contained machine housing 118 (see FIG. 1), which will be described in a subsequent section called Description OF A Second Embodiment OF THE INVENTION.

As pointed out above, each pneumatic cylinder 21 is double acting; therefore each pressure unit's 20 pneumatic cylinder 21 has an NPT female port 61 on its rear side, where air pressure will propel the piston rod 22 forward when the NPT male connector 60 is connected and the pneumatic tube output air pressure lines 71 are activated (see FIG. 3). Each pneumatic cylinder 21 also includes an NPT female port 62 on its front side, where air pressure will propel the piston rod 22 backward when the NPT male connector 63 is connected and the pneumatic tube output air pressure lines 72 are activated.

Returning attention to FIG. 3, the apparatus or machine 10 further includes a four wheel transporter 90; with a typical pneumatic control circuit 70 and an air compressor 80 as an integrated unit supplying pneumatic power for the plurality of pressure unites 20. Note that since the connecting of such pneumatic control circuits 70 is familiar to one skilled in the art, the pneumatic tubing between the pneumatic control circuit 70 and the plurality of pressure units 20 is not shown.

The compressor 80 (of FIG. 3) also includes an electrical box 81 with an on-off switch (not shown) to power the compressor and it includes a primary pneumatic male connector 82 leading to the air input line of the pneumatic control circuit's 70 pressure control valve 74; as well as a secondary pneumatic male connector 83 for connection to the lines of built in pneumatic "nailers" (not shown) attachable to the pressure plates 23 or for attaching an external pneumatic-nail-gun or other equipment. In addition, the compressor 80 and associated pneumatic control circuit 70 include the usual valves (i.e. pressure control valve, a proportional control valve, regulator and so on) familiar to one skilled in the art.

That completes the description of the first embodiment of the invention. Now attention will be focused on the method of using the first embodiment of the present invention to bend the hardwood and install it so that the hardwood floor of the completed installation will have the desired curvature.

Referring to the figures listed (designated FIGS. 1-10 and assuming that non-tongue and groove slats are being installed); a method for installing curved hardwood flooring using the features and functions of the present invention consists of three major steps.

First major step (refer to FIG. 3) is to establish the curved boundary and anchor a plurality of pressure units in place at appropriate intervals to accurately represent the desired curvature of the hardwood floor to be installed. Then connect the pneumatic circuit.

Figure 7:
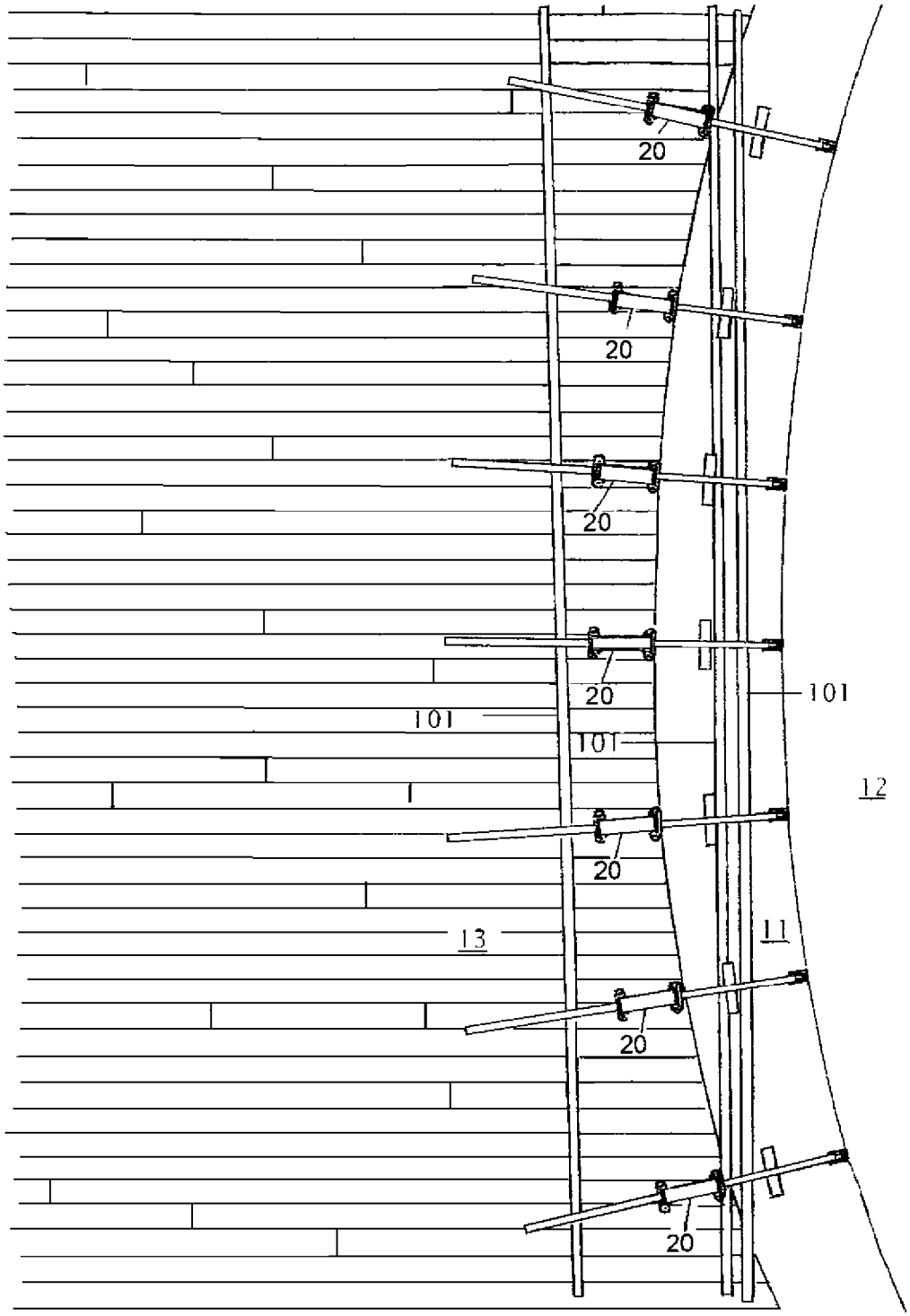
FIG. 7 is a diagrammatic top view of the invention of FIG. 2, showing the wooden slats in an unbent condition, but in the process of being positioned behind the pressure units' pressure plates in preparation for bending.
Figure 8:
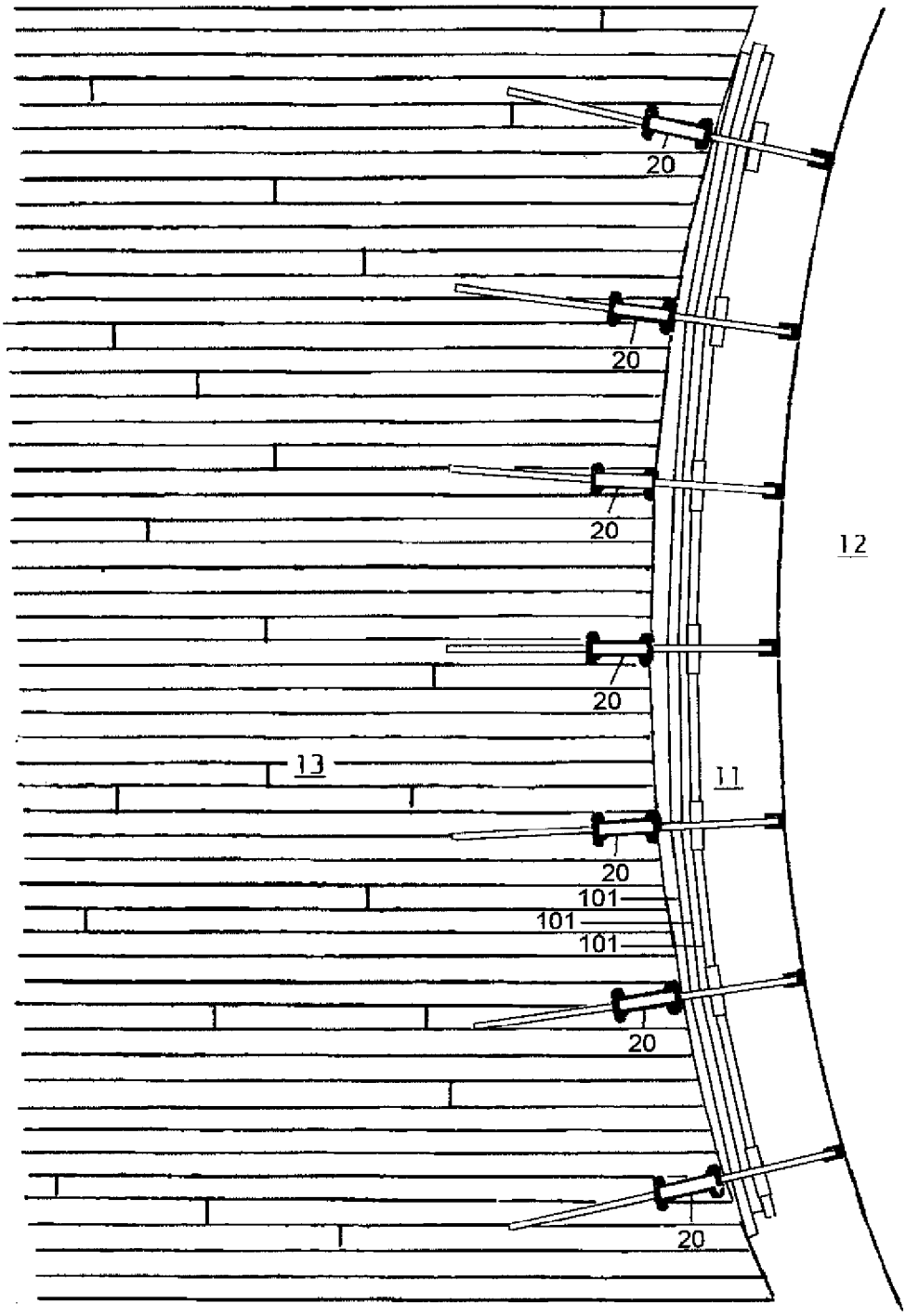
FIG. 8 is a diagrammatic top view similar to that of FIG. 7, showing the wooden slats positioned inside the pressure units' pressure plates and illustrating initial bending of the slats which start to conform to the desired curvature.

Second major step is to make appropriate adjustments to the pressure units 20 and position the hardwood flooring in the apparatus; i.e. behind the pressure plates 23 (see FIGS. 7-8).

Third major step is to make appropriate adjustments to the relative position of the slats 101 to each other; activate the pressure units 20 to bend the flooring into the desired curve; hold securely; make additional adjustments (including cutting the ends of the grouped slats 101, even), and face-nail (or edge-nail if appropriate) the slats 101 to the sub-floor 11. Then repeat major steps 2 and 3 until the hardwood floor is installed.

A good place to start major step 1 is to examine the floor and structures in the immediate area where the hardwood floor is expected to be installed. This may help establish the right curve to use to shape the section of flooring. The need to install curved hardwood flooring frequently comes about because the area to be covered has one or more irregularly shaped walls or some other predefined floor boundary that is not straight; and the traditional "easily shaped" flooring such as carpeting or floor tile does not address the architectural "look" desired, the planned use of the room or its practical limitations.

Thus for illustrative purposes, refer to FIG. 1, where it can be seen that the floor area itself, comprising of sub-flooring 11 and existing boundaries 12 and 13 affixed to the sub-floor, forms a predefined shape or curve that could be used to establish the boundary for the installation of the curved hardwood flooring.

To complete major step 1, the pressure units 20 must be anchored with their pressure plates properly positioned and at appropriate intervals around the perimeter of established boundaries 12 and 13 to accurately represent its curvature. To do this, several decisions must be made as to:

Which of the boundaries 12 or 13 should be used as the fixed curved structure against which the hardwood flooring will be installed?

How will the pressure units 20 be anchored?

What type of slats 101 should be used for the installation (i.e. will tongue and groove slats 101 be used?);

whether multiple slats 101 will be installed simultaneously or one at a time; and Whether the slats 101 will be pulled into position or pushed into position.

One skilled in the art would have a feel for how to answer these questions once they have examined the installation environment. A review of FIG. 1 reveals that one approach to setting up this installation is to use the edge of the finished floor (boundary 13) as the fixed curved structure against which the curved hardwood flooring (slats 101) will be installed. That means that the low wall (boundary 12) could be used to anchor the pressure units 20 to a vertical structure as described earlier (anchoring technique #1) using the pivot bracket 42 shown in FIGS. 4 and 5.

Referring to FIG. 1, to answer the question as to the type of slats 101 to use would depend on whether one wished to match the look of the existing traditional hardwood floor (boundary 13) and the relative tradeoff of installing tongue and groove slats 101 one at a time, but hiding all of the nails because they are nailed at 45 degrees into the tongue vs. using non-tongue and groove slats 101 installed 3 at a time and face-nailing them; but spending more time sanding, wood filling, and staining after the installation. Either decision would suggest groups of 3 slats 101 (¾" each which would equal a 2¼" width standard plank) should be installed to match the existing traditional hardwood floors (boundary 13).

Figure 9:
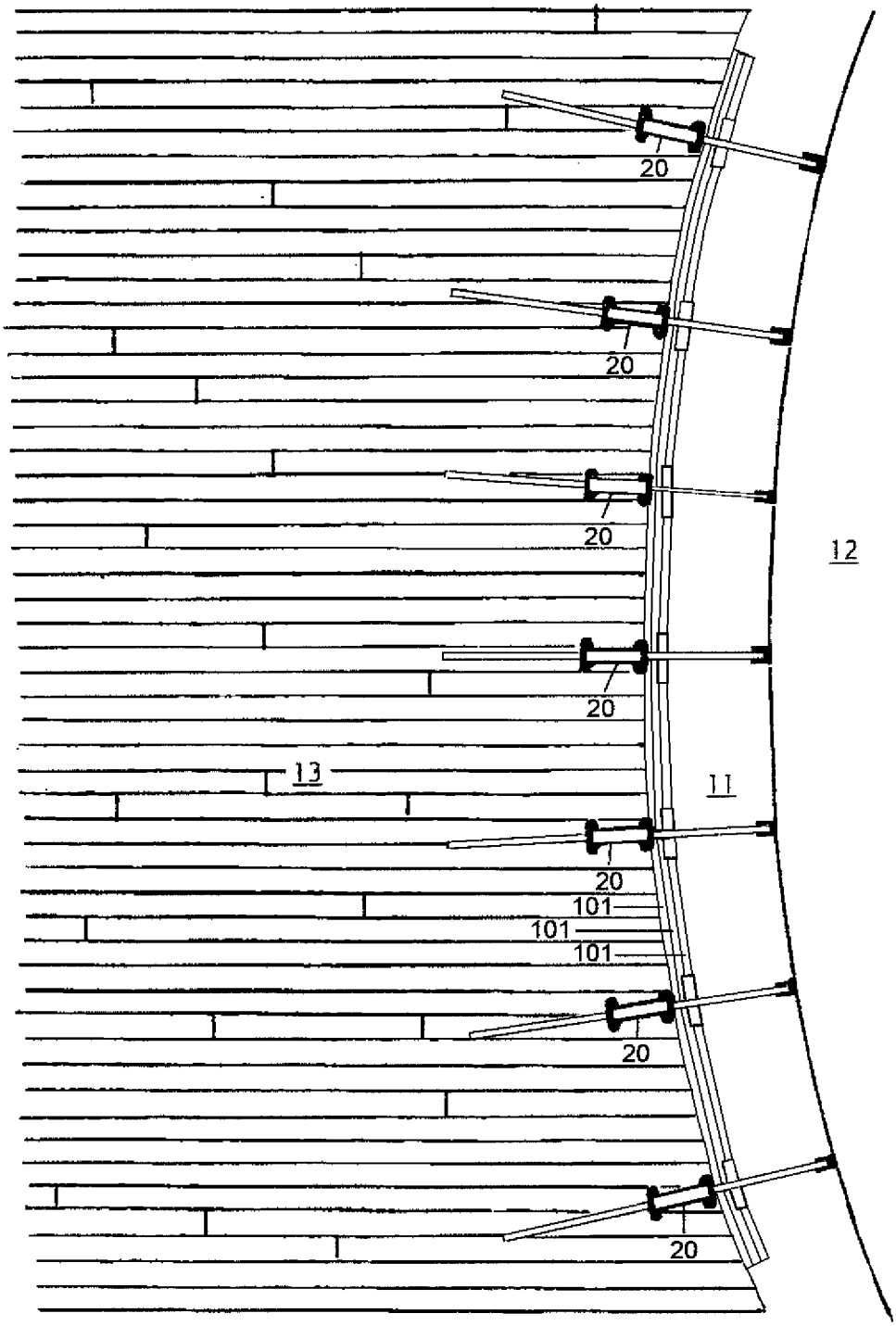
FIG. 9 is a diagrammatic top view similar to that of FIG. 8, showing the wooden slats positioned inside the pressure units' pressure plates and illustrating the slats bent to their finished position which is shown to conform to the desired curvature.

The decision as to whether multiple slats 101 will be installed simultaneously or one at a time is relatively easy because if tongue and groove slats 101 are used then the answer is one if they are to be installed as designed; however if non tongue and groove slats 101 are used then there is no reason not to take advantage of the power of the apparatus or machine to install multiple slats 101 at a time. For illustrative purposes, FIGS. 7-9 show the installation of non-tongue and groove slats 101, which are face-nailed in groups of 3 to match the existing traditional hardwood flooring (boundary 13) in FIG. 1. It should be noted that groups of three tongue and groove slats 101 (after the first row is installed) could be simultaneously installed if the first two slats 101 in each subsequent group were glued together at their tongue and groove interface; glue placed on the underside of the group of three slats 101; then installed using the teachings of this invention and appropriately adjusted (discussed later) before the glue is dry, then edge-nailed through the tongue of the third slat into the sub floor. The bond formed by the glue at the tongue and groove and underside of each group of three slats 101 should be strong enough to replace the individual nailing through the tongue and groove of the first two slats 101 of each group of three.

With answers to the first 4 questions, it follows that the slats 101 should be pulled into position against the edge of the finished floor (boundary 13), because the floor being laid is too close to the low wall (boundary 12) which would interfere with the operation of the pneumatic cylinders if the slats 101 were pushed. Thus boundary 13 is the fixed curved structure against which the curved hardwood flooring (slats 101) should be pulled during installation; while using the low wall (boundary 12) as the anchor point.

With all five questions answered, all that remains to complete major step 1 is to properly anchor the pressure units 20. Experience with the apparatus or machine 10 has shown that an arc length of about 10 feet drawn from a radius of about 12 feet yields a curve that can be accurately duplicated by placement of each pressure unit 20 approximately 18" apart (measured center to center of the front edge of adjacent pressure unit's 20 front mounting bracket 30). The pressure units 20 should be at right angles to the curve (i.e. in FIG. 2 the edge of the finished floor or boundary 13). Note that as the arc radius grows, the pressure units 20 could be placed a little further apart. Conversely, as the curve become tighter (i.e. the arc radius become shorter, then the pressure units 20 have to be placed closer to each other in order to accurately represent the desired curvature of the hardwood floor to be installed. That means that for a shorter arc radius, more pressure units would be required and placed closer together to install the same linear distance of curved hardwood flooring. The practical implications are that for large floor installations or complex curved floor designs, such floors will likely be installed in sections using a fixed number of pressure units. Calculations reveal that it would take 7 pressure units 20 to install a 10 foot arc length (from a 12 foot arc radius) section of curved hardwood flooring if the pressure units were placed 18" apart. Experience has shown that determining the separation distance between adjacent cylinders for a curve of a specified arc radius does not require undue experimentation for someone skilled in the art of working with wood and associated tools. Note that the boundaries 12 and 13 were assumed to have a circular arc for illustrative purposes. This simplified the discussion. However, the apparatus or machine 10 could be used with a curve of any complexity (e.g. a compound curve with radii of various lengths).

Continuing with the first major step, refer to the first pressure unit 20 in the foreground of FIG. 3 and to the exploded view of a pressure unit 20 in FIG. 5 for the discussion on positioning the pressure units 20. With the spacing between the pressure units decided, the first pressure unit 20 should be positioned so that the edge of the front mounting bracket 30 (see FIG. 4) sits on and parallel to the edge of the existing traditional hardwood floor (boundary 13). From a vantage point directly behind the pressure unit 20, look down the longitudinal axis that runs concurrent with the center of the threaded anchor rod 34. Mark the spot where the longitudinal axis intersects the low wall. The pivot bracket 42 that anchors the pressure unit 20 to the low wall should be mounted at a distance above the marked spot equivalent to the distance between the mounting screw hole and the carter pin holes of the pivot bracket 42. Once the first pressure unit 20 is mounted, then the remaining pressure units should be mounted using the same procedure, at the same elevation at the low wall 1 2. The front mounting bracket 30 of adjacent pressure units 20 should be the computed distance (i.e. 18" in this example) apart center to center as shown in FIG. 3 with their front mounting brackets 30 resting on the edge of the finished floor (boundary 13). Complete major step 1 by connecting the pneumatic circuit 70.

Now that major step 1 has been completed, focus can be place on major step 2, which is make appropriate adjustments to the pressure units 20 and position the hardwood flooring in the machine. All of the pressure units 20 should be positioned so that the edge of their front mounting brackets 30 (see FIGS. 3 and 4) touch the edge of, and sit parallel to the edge of the existing traditional hardwood floor (boundary 13). Any pressure unit 20 that does not meet this specification should be adjusted laterally and longitudinally to line it up properly. The lateral adjustment is simple; just move the back of the pressure unit 20 in the necessary direction. To make a longitudinal adjustment locate the two longitudinal adjusting nuts 37 on the threaded anchor rod 34 in FIG. 4. From a vantage point directly behind the pressure unit 20, rotate the longitudinal adjusting nuts 37 clockwise to move the pressure units 20 forward and rotate the longitudinal adjusting nuts 37 counterclockwise to move the pressure units 20 back.

Refer to FIGS. 6-10 for this discussion. Now that the pressure units are all aligned, the focus can be turned to the latter part of major step 2, which is to position the hardwood flooring (slats 101) in the machine; i.e. so that the pressure plates 23, when activated, can pull them against the edge of the finished floor (boundary 13) which is the fixed curved structure that molds the slats 101 into the desired curve. For illustration purposes, recall that the slats 101 are of the non-tongue and groove type and are being installed in groups of 3's simultaneously. Also the length of each slat is 10 feet. All 3 slats 101 should be placed on the sub-floor 11 area between the edge of the existing traditional hardwood floor (boundary 13) and the scratch avoidance pad 50 of the plain pull pressure plate 23. FIG. 7 shows 3 slats about to be positioned. FIG. 7 also shows two of the slats in the appropriate area of the first pressure unit 20, which is located in the foreground (near the bottom edge of the page). Once all 3 slats 101 are similarly positioned in the pressure units 20 (as shown in FIG. 8), they will be slightly curved, illustrating initial bending of the slats and a sign that they are starting to conform to the desired curvature.

Now that major step 2 has been completed, focus can be place on major step 3, which is to first make appropriate adjustments to the relative position of the slats 101 to each other. These kinds of adjustments are familiar to one skilled in the art of installing hardwood floors. This sub-step is critical because, if appropriate adjustments are not made, the overall appearance of the floor will suffer. Look for correct end joint alignment, particularly at whichever end is deemed the starting point. Corrections can usually be made with a light tap on the ends using a rubber mallet. This is particularly important if one wishes to match the appearance (using the 3 slats 101) with existing traditional hardwood flooring in the same room. Thus the starting joints usually are be perfectly even and perpendicular to the edge of the existing hardwood floor (boundary 13); unless one is also following the contour of a side wall or other structure.

Refer to FIGS. 7-9 for this discussion. Continuing with major step 2, after appropriate adjustments have been made and the pneumatic circuit has been activated, the pressure plates 23 will pull the slats 101 against the edge of the finished floor (boundary 13). Consequently the force of the pressure plates 23 across the group of 3 slats' 101 entire length at multiple points will hold the slats 101 against this curved structure in the shape of the desired curve, until it is nailed to the sub-floor using the pneumatic-nail-gun or optional built in pneumatic nailer at each pressure plate 23.

Before nailing, check alignment again, at both ends of the slats 101. After the apparatus or machine 10 has been fully activated causing the slats 101 to fully conform to the desired curve, adjustments at the other end may be necessary. Perhaps this time by cutting the slats 101 at right angles to the curved boundary 13 to ensure that the set of 3 slats 101 are even. It is possible to cut them evenly if 1) the initial 3 slats 101 were the same length before installation; 2) care was taken to ensure that the slats 101 were even at their starting point by making appropriate adjustments; and 3) an appropriate cutting tool is used to make the adjustment at the back end.

If the floor is being installed in sections as discussed earlier and this is the second or higher row of a group of 3 slats 101 to be installed, then this row and each succeeding row should be installed while ensuring proper staggering of each group of 3 slats 101 at the end of adjacent rows, to avoid clustering end joints just as in traditional hardwood floor installations. Otherwise if this is the only section or the last section, each row of slats 101 should be cut to follow the contour of the adjacent wall or structure.

Some of these adjustments can be avoided altogether if the individual slats 101 are allowed to overlap just like they do when installing traditional hardwood flooring. However one must still be attentive to staggering the ends of the individual slats 101 by several inches to avoid clustering end joints.

Once it is clear that all adjustments have been made, the slats 101 can be permanently face-nailed to the sub-floor using the pneumatic-nail-gun or optional built-in pneumatic "nailer" at the pressure plate 23 of each pressure unit 20. Then repeat the above major steps 2 and 3 sequence until the hardwood floor installation has been completed. Note that as the slats are permanently installed, they become the new curved edge against which the next row of slats 101 will be installed.

The sequence of major steps is essentially the same if the slats 101 are tongue and groove type assuming everything else is the same, except that:

The slats 101 are installed one at a time (unless glue is substituted as discussed earlier); but may still be grouped in sets of 3's;

The pressure plate 23 used should be the one shown in the 1st column of the 3rd row in FIG. 6; i.e., the pull pressure plate-tongue facing if the slats are being pulled into position against the curved edge of the traditional hardwood floor and the tongue is facing the pressure plate.

The tongue and groove slats 101 are nailed at a 45 degree angle (after the first row) through the tongue and into the sub-floor instead of face-nailed. Thus the nails will be hidden from view.

Figure 10:
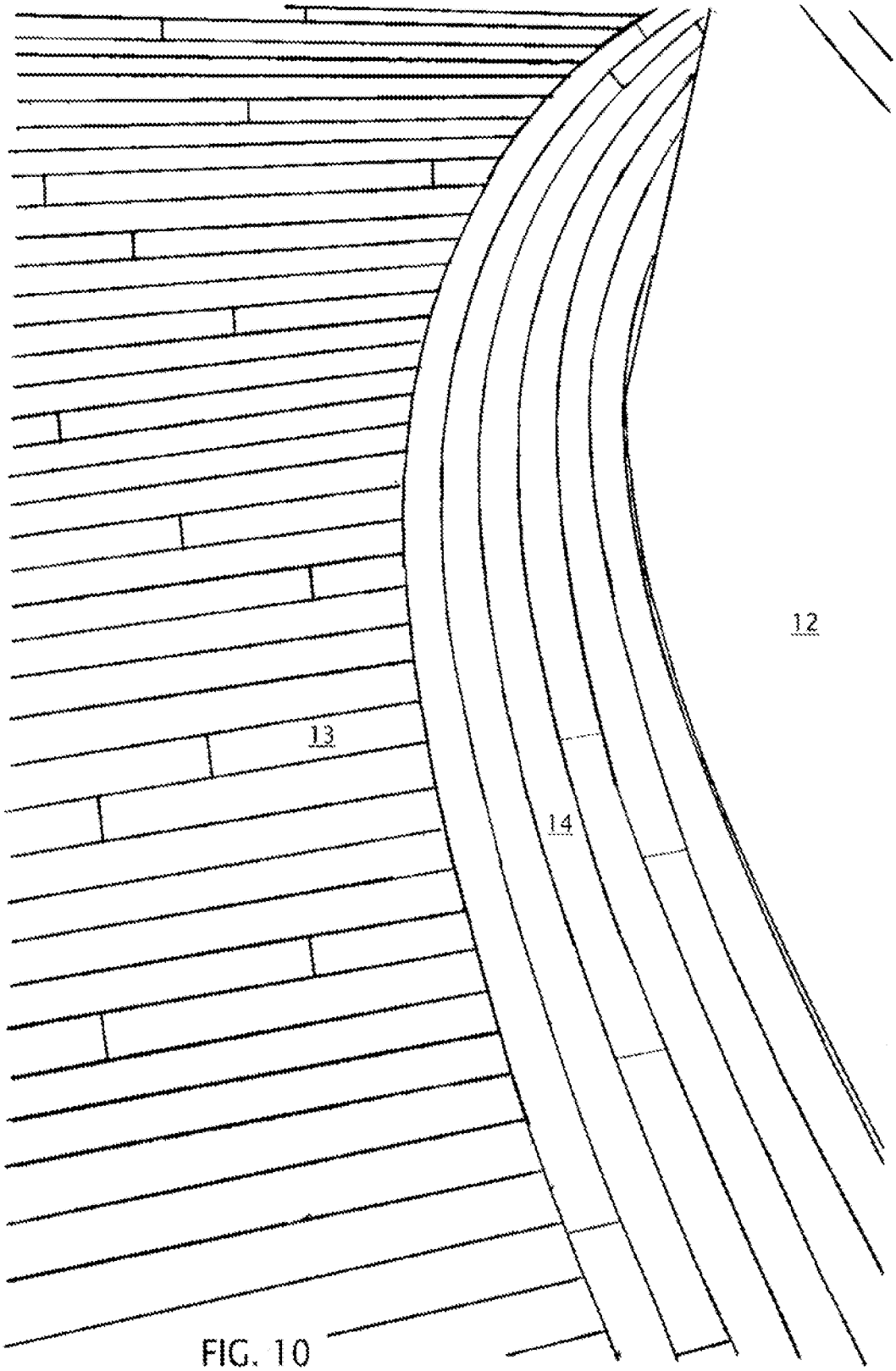
FIG. 10 is a perspective view similar to that of FIG. 1, showing the same section of flooring depicted in FIG. 9 after the installation of all of the wooden slats around the curved low wall and the removal of the pressure units.

FIG. 10 shows the completed curved hardwood floor 14.

DESCRIPTION OF A SECOND EMBODIMENT OF THE INVENTION

Figure 11:
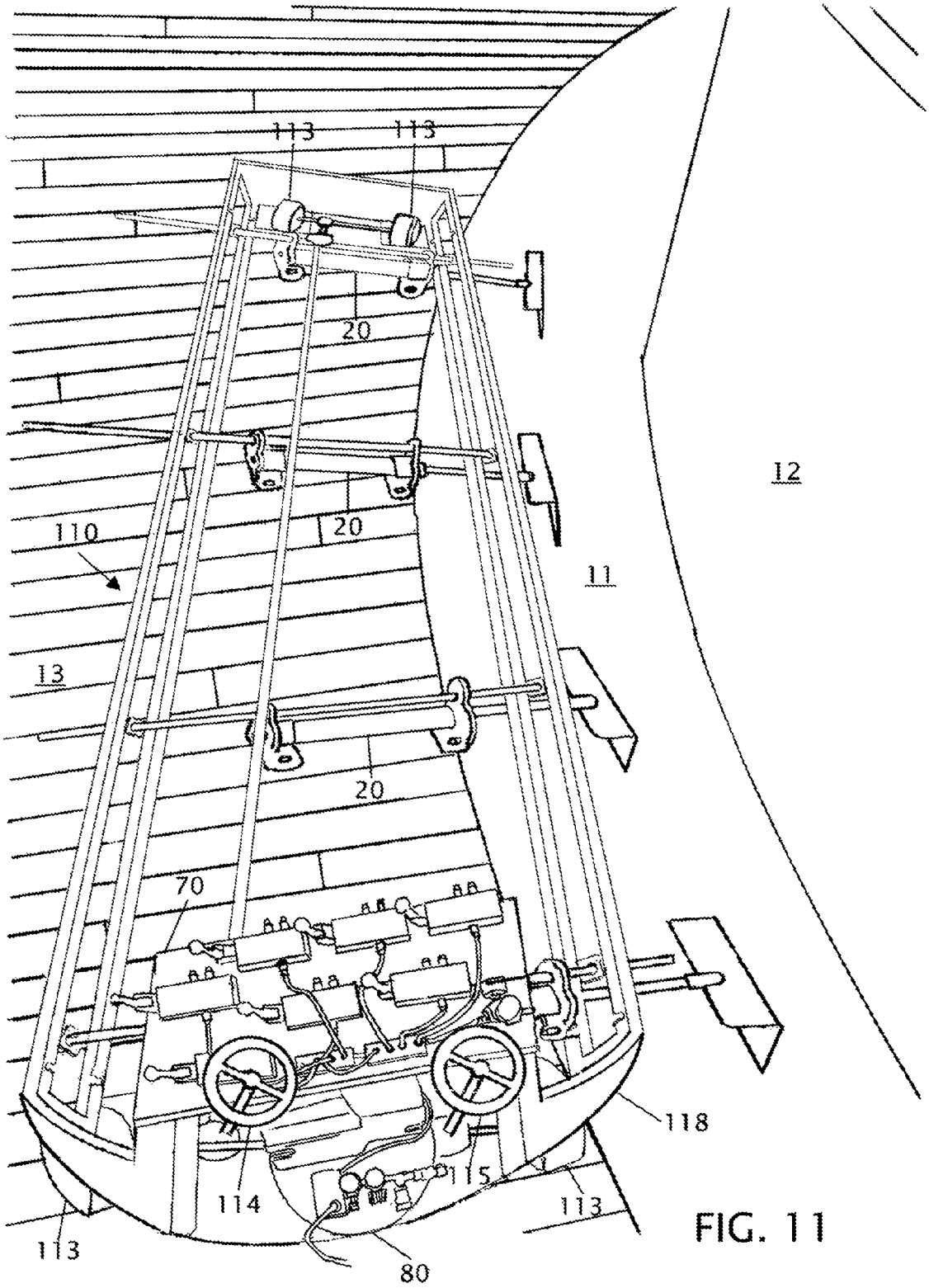
FIG. 11 is a perspective view of a second embodiment of the present invention, implemented with a plurality of pressure units integrated into a self contained mobile housing containing all of the components necessary for installing curved hardwood flooring.
Figure 12:
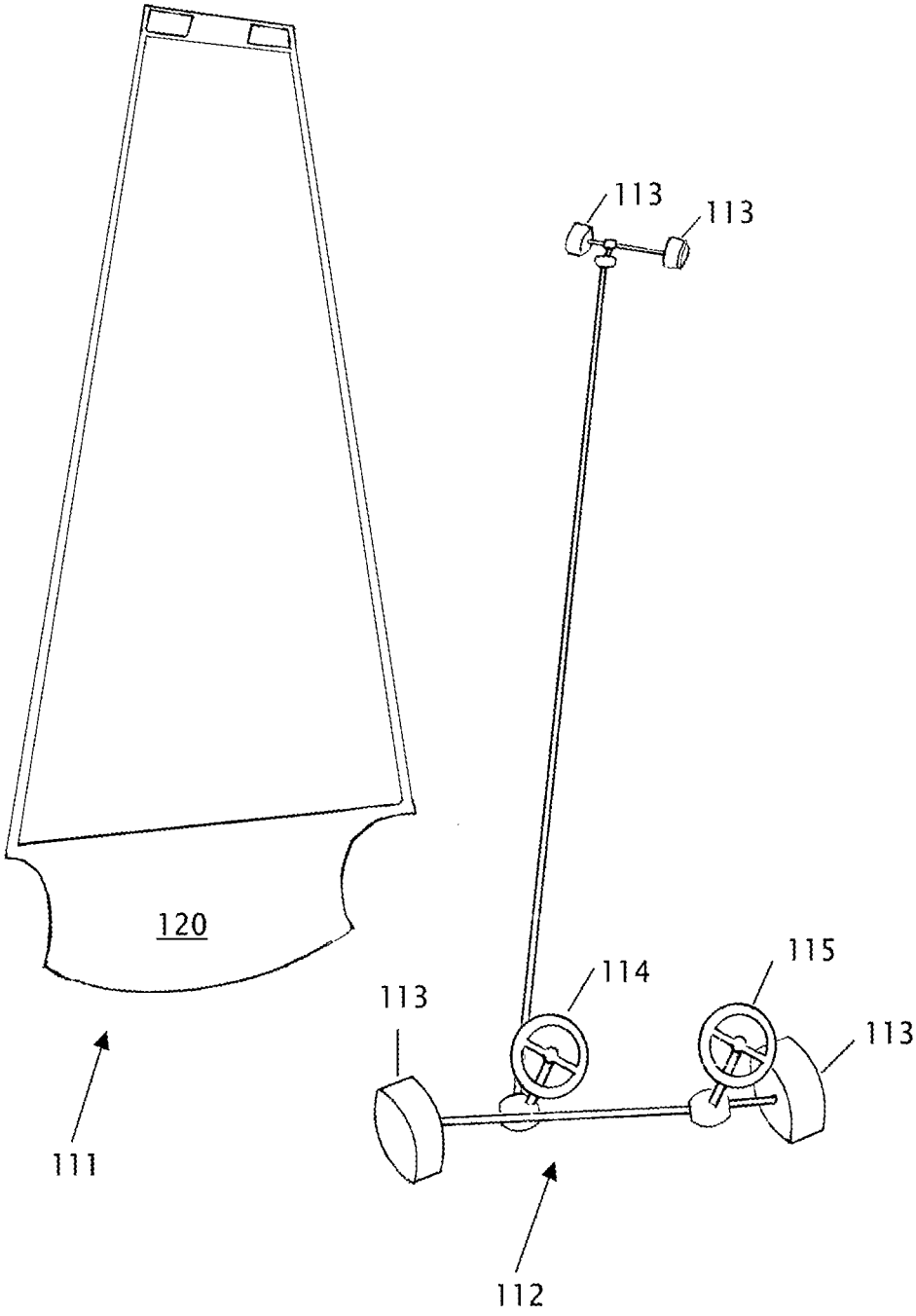
FIGS. 12-14 show exploded views of the perspective view of FIG. 11.
Figure 13:
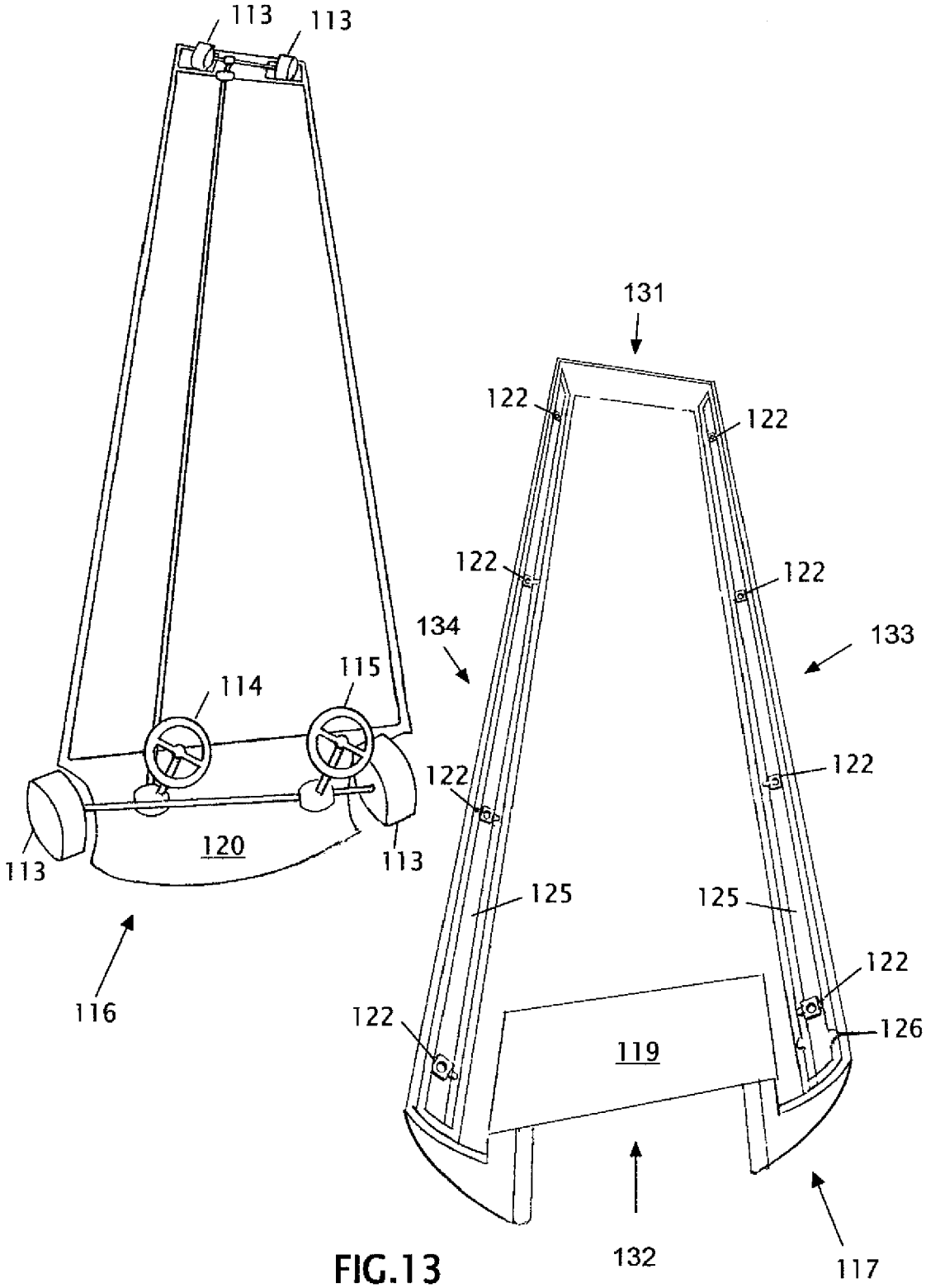
Figure 14:
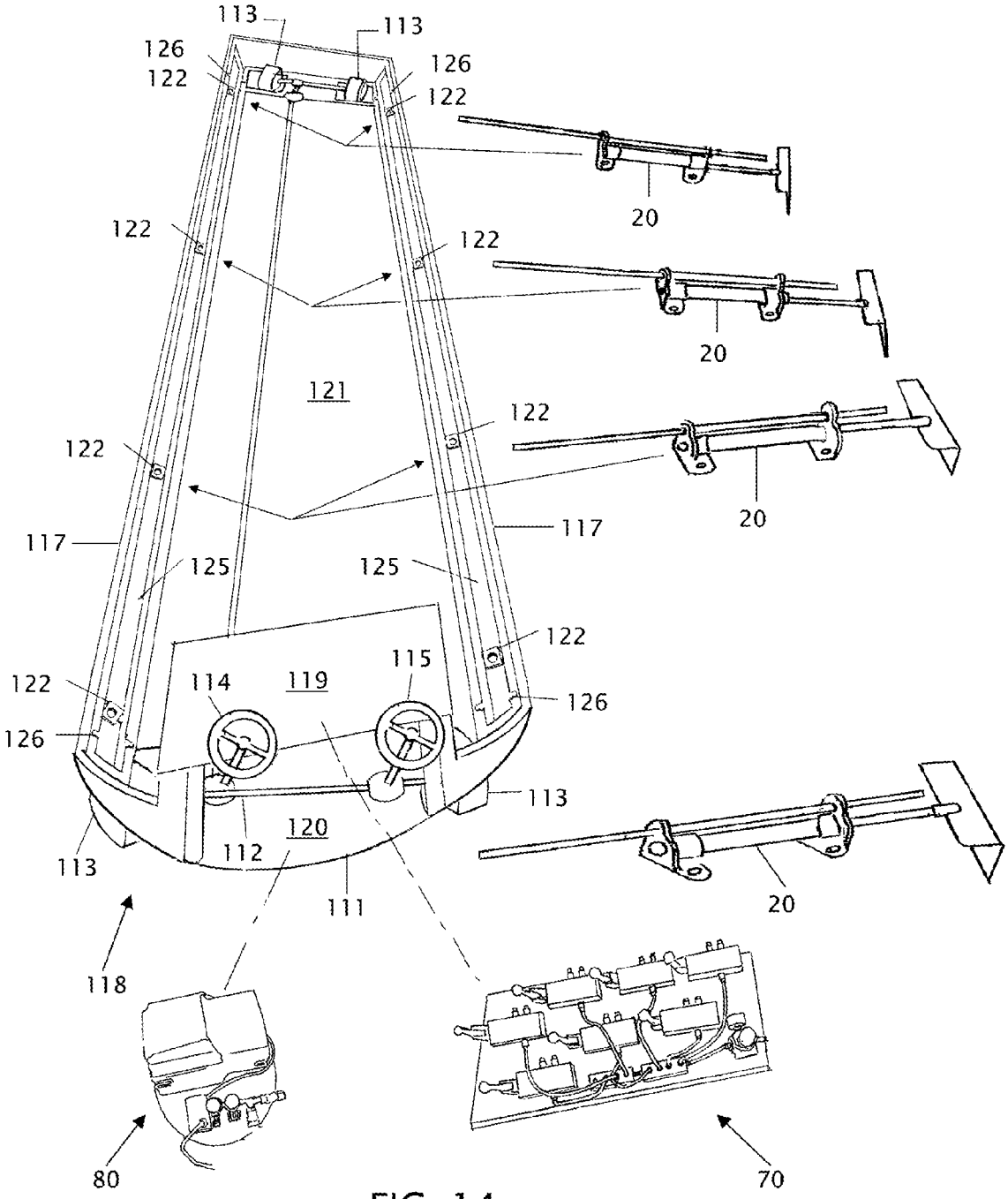
Figure 15:
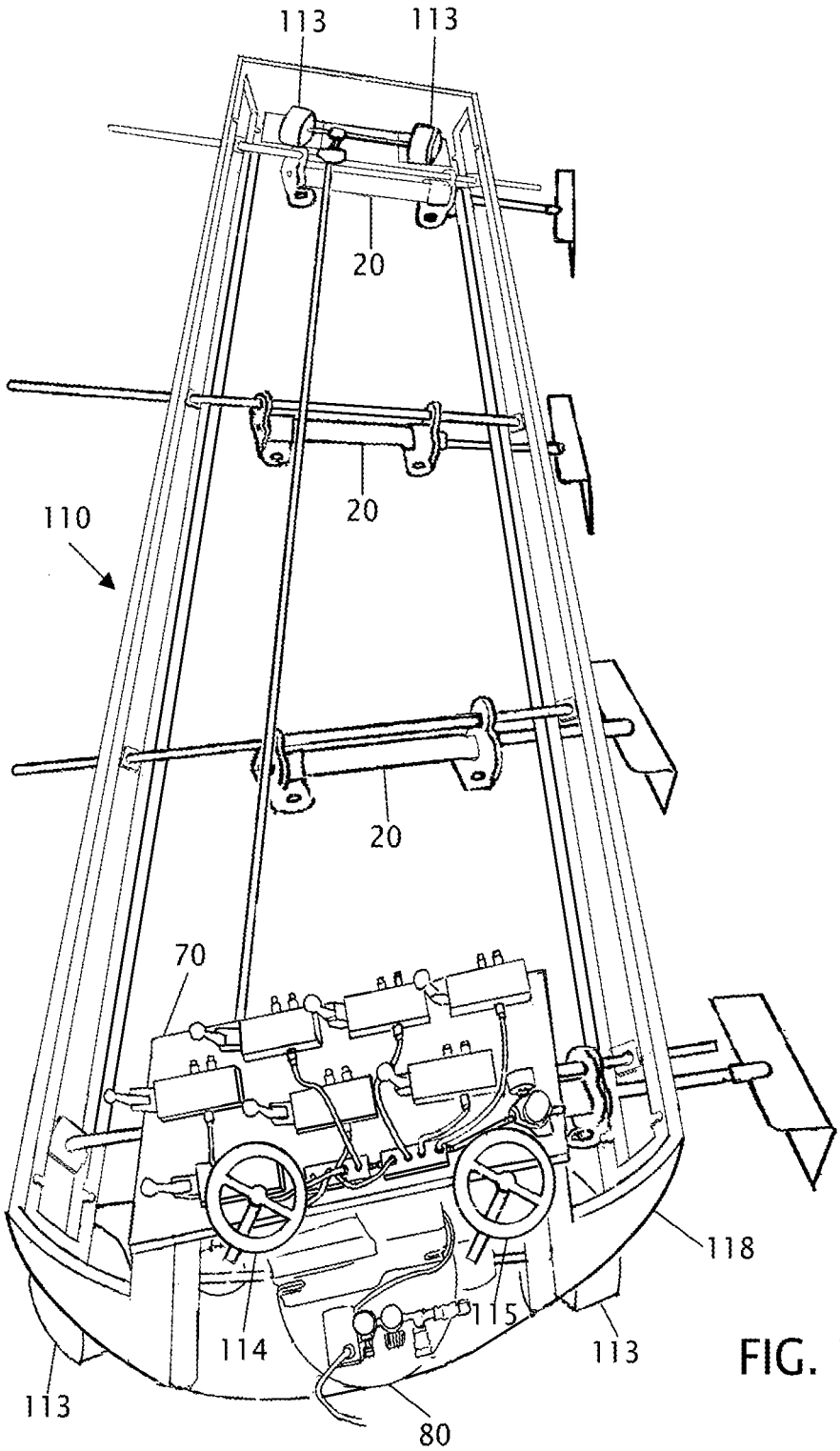
FIG. 15 is a perspective view similar to that of FIG. 11; but with the sub-flooring and curved structures removed.
Figure 16:
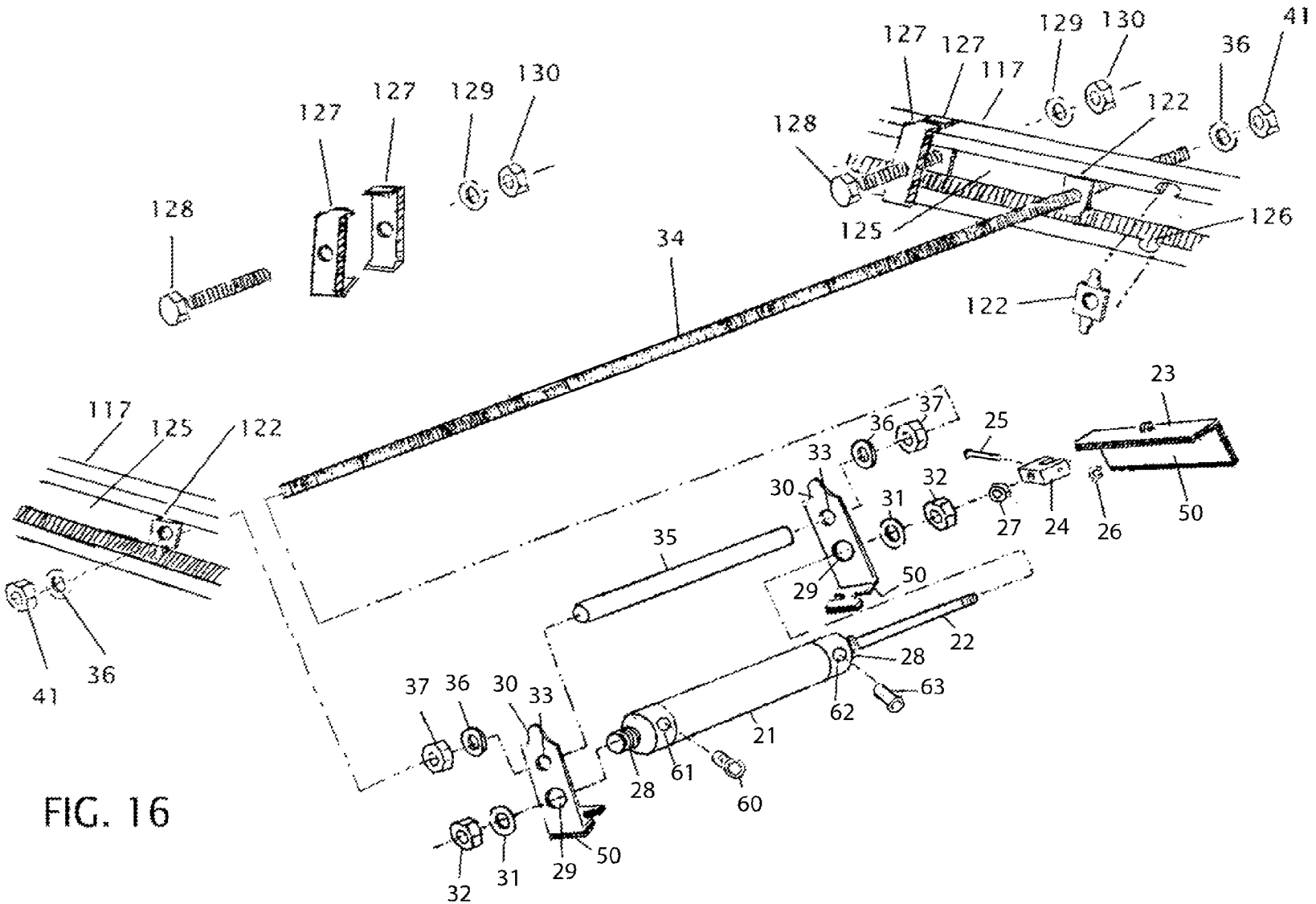
FIG. 16 is an exploded view of a section of the perspective view of FIG. 11 showing how the pressure unit is anchored in the machine housing.

FIG. 11 shows a second embodiment of the present invention. It is a machine that contains all of the components of the present invention packaged into a single machine housing 118 (typically metal and/or structural plastic) for ease of transport, assembly and use. Note that like components are represented by like reference numerals since many of the components in FIGS. 1-6 are identical to those shown in FIGS. 11-16.

The second embodiment of the present invention will be described first, and then the method of using it to bend hardwood flooring to conform to the desired curve, will be described. The fully assembled machine 110 of the second embodiment shown in FIG. 11 is positioned in the area of the floor to be covered (see FIG. 1) which consists of the sub-floor 11 with existing boundaries 12 and 13 affixed to the sub-floor. Its major components are shown in exploded views in FIGS. 12-14. The machine 110 further includes a bottom frame 111 to which is secured (by one of several conventional means to one skilled in the art such as welding, screws, nuts and bolts, etc.; not shown) a means for independently controlling the steering 112 of the front and rear wheels 113; via a front steering wheel 114 and a rear steering wheel 115. The bottom frame 111 further includes a bottom support level 120 at its back end. Thus creating a bottom mobility and support structure 116 (see FIG. 13). The machine 110 further comprises the side frame 117 (having front 131, back 132, left 134 and right 133 sides or lateral walls). The side frame 117 further includes a top support level 119 at its back end. The side frame 117 is similarly secured to the bottom frame 111. The results is a machine housing 118 (see FIG. 14) with the two support levels 119 and 120 located in the back of the machine housing 118, which are support structures for additional components of the present invention.

The machine 110 also contains pneumatic control circuit 70 which is removably secured (by conventional means such as screws, nuts and bolts, etc. that can easily be removed with common tools) to the top support level 119; and compressor 80 which is also removably secured to the bottom support level 120. The machine 110 further contains a pressure unit compartment 121 defined by the open area formed by the left 134 and right 133 sides of the side frame 117, the area where the front wheels 113 are located and the area where the bottom support level 120 is located at its back. The resultant pressure unit compartment 121 is an area about 10 feet long by about 4 feet wide; and can accommodate 7 of the same pressure units 20 discussed in the first embodiment, equally spaced 18" center-to-center at the side from which the piston rods 22 extend facing the unfinished floor 11 (FIG. 1; note that only 4 pressure units 20 are shown instead of 7 to allow more detail to be shown without cluttering the diagram). Also a shorter machine housing 118 could be used if space is limited simply by using a shorter side frame 117.

Assume that the installation environment is the same as that described in the first embodiment. Referring to FIGS. 11-16, instead of the pressure units 20 being mounted on the vertical structure (boundary 12); they are anchored in the machine housing 118. Note that pneumatic cylinders 21 with a longer reach (i.e. stroke length) could be used to minimize the number of times that the machine would have to be repositioned during installation of a large area of flooring (i.e. important for wide floors). However a pneumatic cylinder 21 with the same size bore could be used. Therefore the nuts, bolts and associated hardware referenced in the first embodiment could also be used. Experience shows that for a wide range of installations including the one described in FIG. 1, a stroke length of about 14" and an overall length of slightly over 31" (when fully extended) would be adequate. The threaded anchor rod 34 should also be at least 5 feet long to accommodate the width of the machine housing 118 and allow for the fact that the anchor rods 34 are usually anchored at an angle other than a right angle to the sides of the machine housing 118. This means that the threaded anchor rod 34 must be equal to or greater than the width of the machine housing 118 plus accommodate the thickness of its lateral walls with a washer 36 and locknut 41 at both ends and the additional length required because of the angle that the threaded anchor rod 34 may make with the lateral walls.

The machine housing 118 (see FIG. 14), further includes a grooved channel 125 that runs longitudinally along the lateral walls of the pressure unit compartment 121 and stops a few inches (e.g. 3" is sufficient) before its ends. At least one notched area 126 should be located in the grooved channel 125. The machine housing 118 further includes a plurality of swivel nuts 122 (see close-up in FIG. 16) that have a shape to match the notched area 126 and can be inserted into the notched area 126 and positioned along the grooved channel 125 for anchoring the pressure units 20 at appropriate points along the left and right walls of the pressure unit compartment 121. Each swivel nut 122 can rotate 360 degrees on its axis in the grooved channel 125; thus allowing the front surface of corresponding swivel nuts 122 in opposite side walls of the machine housing 118 to be parallel to each other. This allows the pressure units 20 to be properly anchored and locked into position even when their longitudinal axes are not perpendicular to the lateral walls of the side frame 117 of the machine housing 118. The appropriate elevation, longitudinal and lateral position for each pressure unit 20 will be subsequently discussed when describing the method of using the second embodiment.

The pressure units 20 are assembled in the same way as described in the Detailed Description of the First Embodiment of the Invention that refers to FIG. 5; except that each pressure unit 20 (see FIGS. 15-16) is anchored in the machine housing 118 by screwing the threaded anchor rod 34 through one of the swivel nuts 122 in the lateral wall of the side frame 117 on one side of the machine housing 118, then assembled as described in the first embodiment by treading the anchor rod 34 through the longitudinal adjusting nuts 37, washers 36, top holes 33 (of the two mounting brackets 30 that sandwiches the pneumatic cylinder 21 and spacer tube 35); before screwing it through the corresponding swivel nut 122 in the lateral wall of the side frame 117 on the other side of the machine housing 118; and finally securing it at both ends with 1) blocking clamps 127, bolts 128, washers 129 and nuts 130 on both sides of the swivel nut 122 to prevent lateral movement of the pressure unit 20; and 2) a washer 36 and locknut 41 on the outside surface of the corresponding swivel nuts 122 located in the opposite lateral wall of the machine housing 118.

The number of pressure units 20 that can be held in the pressure unit compartment 121 depends on the distance between pressure units 20. Recall that the particular floor area to be covered, described in FIG. 1 required that the pressure units be spaced about 18" apart or less to accurately represent the desired curve. Therefore at 18" apart, 10 foot long pressure unit compartment 121 would hold 7 pressure units 20 with approximately 6" on the far side of the end pressure units 20. If the arc radius were shorter or if a more complex curve were involved then the pressure units would be closer together and more pressure units 20 (and associated components like control valves in the control circuit 70) would be used. Alternatively the floor could be laid in sections.

That completes the description of the second embodiment of the present invention. Now attention will be focused on the method of using it to bend and install the hardwood so that the hardwood floor of the completed installation will have the desired curvature.

Referring to the figures listed (designated FIGS. 11-16 and assuming that non-tongue and groove slats are being installed); the method for installing curved hardwood flooring using the second embodiment comprises the same three major steps used with the first embodiment; therefore the following discussion highlights only what essentially are the differences.

For the first major step, which is to establish the curved boundary, anchor the pressure units at appropriate intervals and connect the pneumatic circuit, the difference is that the pressure units are already anchored in the machine housing 118 but the machine housing 118 will have to be positioned (both its elevation and location) before the pressure units 20 can be positioned to represent the desired curve.

The first major step is achieved by the following sub-steps:

determine the elevation by sitting a pressure unit 20 on the finished floor, near its edge (i.e. the boundary 13 of FIG. 1) and measuring the distance from the sub-floor 11 to the center of the threaded anchor rod 34; when the pressure units 20 are installed, the longitudinal center of their threaded anchor rods 34 should be anchored at the measured elevation above the sub-floor with the base of their mounting brackets 30 touching but not supported by the finished floor; thus the center of the grooved channel 125 that runs the length of the lateral walls of the pressure unit compartment 121 should also be at that measured elevation above the sub-floor; the machine housing 118 should be ratcheted (not shown) or otherwise adjusted up or down at or near each wheel 113 to achieve the desired elevation;

mark a starting point for the first section of hardwood flooring at the edge of the curved boundary 13;

measure and mark the end point equal to the length of the pressure unit compartment 121 from the starting point and continue along the perimeter of the curved boundary 13; Note that in keeping with the installation environment outlined in FIG.] that distance is set at 10 feet but it could be shorter depending on the size of the room, arc length, length of slats 101 used, complexity of the curved boundary, etc.;

determine the optimum distance (i.e. separation distance) between adjacent pressure units 20 based on the characteristics (i.e. arc length, arc radius, curve complexity, etc.) of the desired curve;

calculate the approximate number of pressure units 20 (i.e. arc length divided by separation distance) that should be installed to accurately represent the desired curve (e.g. 120"/18" yields approximately 7 pressure units 20);

mark the center of the arc between the starting point and ending point; with an odd number of pressure units 20, the first one will be anchored above this mark; and with an even number of pressure units 20, the first two will be anchored above the two marked points along the edge of boundary 13, both points located at half the separation distance either side of the marked center; thereafter each subsequent set of two pressure units 20 will be anchored above marked points along the edge of boundary 13 located at the separation distance measured from the two immediate preceding marked point or points towards the starting and ending points respectively, until all marked points are determined for the required number of pressure units;

maneuver (Refer to FIG. 11) the machine housing 118 into position using the front steering wheel 114 and rear steering wheel 115; for the installation environment described in FIG. 1, the notched areas 126 at the front and back of the machine housing 118 should be placed directly over the curved boundary 13; and the marked starting and ending points should be sandwiched by and centered between the two notched areas 126; with the side of the machine housing 118 (i.e. where the pressure plates 23 are protruding out) facing the sub-floor 11 to be covered;

lock (not shown) all 4 wheels 113 into place to prevent the machine housing 118 from moving. If necessary, the machine housing 118 could also be anchored to a fixed structure to prevent movement.

Now that the machine housing 118 has been strategically placed over the marked locations at the edge of the curved boundary 13, the pressure units (refer to FIGS. 11 and 16 for details) can be located over the marked positions as follows: release the locknuts 41, washers 36 and corresponding blocking clamps 127, bolts 128, washers 129 and nuts 130 that secures each pressure units' 20 threaded anchor rod 34 to the lateral walls of the machine housing 118. Slide the pressure units 20 along the grooved channel 125 to positions such that the longitudinal center of the threaded mounting rod 34 of each pressure unit passes directly over the marked points at the front edge of the curved boundary 13. If the machine housing 118 was correctly positioned then the edge of each pressure unit's 20 front mounting bracket 30 should be easily positioned directly over the marked point at the edge of the curved boundary 13. If it is not, then make appropriate adjustments to the position of the machine housing 118, the position of the threaded anchor rod 34 in the grooved channel 125. Once this is done the longitudinal position of the pressure unit 20 (as discussed under the same topic in the first embodiment section) can be adjusted. From a vantage point directly behind each pressure unit 20, look down the longitudinal axis of each threaded anchor rod 34. Note whether the edge of the corresponding front mounting bracket 30 sits over and is parallel to the marked point at the edge of the existing curved boundary 13 located directly under it. Technically, the front edge of each mounting bracket 30 should be parallel to the tangent line that passes through the point on the edge of the curve boundary 13 directly below each pressure unit 20. If a pressure unit is not so positioned then maneuver its back swivel nut 122 along the channel groove 125 and/or its longitudinal adjustment nuts 37 until this criteria is met. Make other adjustments as appropriate. Then secure all the pressure units 20 as described earlier.

With the machine housing and associated pressure units 20 properly positioned, the remaining steps in the method to install the curved hardwood flooring using the second embodiment are essentially the same as that outlined in the first embodiment; with a couple of exceptions. To illustrate the exceptions, assume that all factors are the same including area of the floor being laid, its boundary, number and type of pneumatic units used and stroke length, then the key differences are as follows: for every 10 feet of adjacent flooring installed 1) in the first embodiment, the individual pressure units 20 are all repositioned once, while in the second embodiment, the machine housing 118 is repositioned once; and for a given stroke length 2) in the first embodiment, the pressure units 20 are adjusted longitudinally a number of times equivalent to the width of the floor being laid divided by the stroke length while in the second embodiment, the machine housing 118 itself is repositioned the same number of times, which results in only minor adjustment of the individual pressure units 20 in the machine housing 118. However to achieve the reach needed when laying the floor within a stroke length or so of a vertical structure (e.g. boundary 12) the pressure units 20 anchored in the machine housing 118 may have to be longitudinally adjusted. Whether or not longitudinal adjustments would have to be made would depend on the reach or stroke length of the pressure units 20 and the tightness of the curve (i.e. the shorter the radius, the tighter the curve) around the vertical structure. For many common installations such as the one described in FIG. 1 with a 12 foot radius of curvature and using pressure units 20 with a stroke length of 14", longitudinal adjustments in the vicinity of the boundary 12 would probably not be necessary; however for complex curves with somewhat shorter radii, such adjustments would be necessary. Also in such situations it may be best to use the first embodiment for the section of flooring being laid in the immediate vicinity of such structures.

Note that the method would also be the same if the slats 101 were tongue and groove, except that the hardwood slats 101 would be installed one at a time instead of in groups of 3's unless they were glued together as discussed earlier.

FIG. 10 shows the completed curved hardwood floor 14.

DESCRIPTION OF A THIRD EMBODIMENT OF THE INVENTION

The major aspects of the third embodiment of the invention are the same as the second embodiment except that the machine housing (typically steel and/or structural plastic) is modular and its sides are adjustable so that the machine housing can be shaped to fit the desired curved boundary, but strong enough to withstand the pressure and other forces required to install curved hardwood flooring.

The invention claimed is:

1. A method for installing curved hardwood flooring, comprising the steps of: (a) establishing a curved boundary for a section of flooring to be covered; (b) determining an anchoring strategy; (c) anchoring a plurality of pressure units at appropriate intervals so that the pressure units are positioned to accurately represent the curved boundary; (d) positioning a row of one or more hardwood flooring slat(s) behind a pressure plate corresponding to each of the pressure units; (e) activating the pressure units to bend the hardwood flooring slat(s) against the curved boundary; (f) securing the hardwood flooring slat(s) to the sub-floor;

wherein the hardwood flooring slat(s) now permanently secured become the curved boundary against which the next said row of the hardwood flooring slat(s) will be laid; (g) repeating the establishing, determining, anchoring, positioning, activating, and securing steps until all of the rows of the section of flooring are installed; and (h) repositioning the pressure units to the section of flooring to be covered next and performing the aforementioned steps in this claim until the entire hardwood floor is installed.

2. A method of installing curved hardwood flooring as recited in claim 1, wherein after the anchoring step and before the positioning step, aligning each of the pressure units laterally and longitudinally so that the pressure units are in position to clamp the hardwood flooring slat(s) against the curved boundary.

3. A method of installing curved hardwood flooring as recited in claim 1, wherein after the positioning step and before the activating step, adjusting the relative position of the hardwood flooring slat(s) to each other including correct end joint alignment and alignment with previously installed flooring or structures.

4. A method of installing curved hardwood flooring as recited in claim 1, wherein after the activating step and before the securing step, (a) rechecking and adjusting the relative position of the hardwood flooring slat(s) to each other; whereby rectifying any misalignment of the hardwood flooring slat(s) caused by the activating step, b) cutting the hardwood flooring slat(s) to ensure that the set of said hardwood flooring slat(s) are even, (c) staggering of each row of the set of said hardwood flooring slat(s) beyond the first row to avoid clustering of ends of adjacent rows in said section of flooring, (d) trimming each row of the set of said hardwood flooring slat(s) in the last said section of flooring to follow the contour of the adjacent wall or structures.

5. A method for installing curved hardwood flooring using a machine housing, comprising the steps of: (a) establishing a curved boundary for a section of flooring to be covered; (b) adjusting the elevation of the machine housing; (c) maneuvering the machine housing's longitudinal and lateral position in the section of flooring to be covered so that a plurality of pressure units contained in the machine housing are positioned to accurately represent the curved boundary; (d) aligning the pressure units' longitudinal and lateral position in the machine housing so that the pressure units are in position to clamp the hardwood flooring slat(s) against the curved boundary; (e) positioning a row of one or more hardwood flooring slat(s) behind a pressure plate corresponding to each of the pressure units; (f) activating the pressure units to bend the hardwood flooring slat(s) against the curved boundary; (g) securing the hardwood flooring slat(s) to the sub-floor; wherein the hardwood flooring slat(s) now permanently secured become the curved boundary against which the next said row of the hardwood flooring slat(s) will be laid; (h) repeating the establishing, adjusting, maneuvering, aligning, positioning, activating, and securing steps until all of the rows of the section of flooring are installed; and (i) repositioning the machine housing to the section of flooring to be covered next and performing the aforementioned steps in this claim until the entire hardwood floor is installed.

6. A method of installing curved hardwood flooring as recited in claim 5, wherein the pressure units have not been assembled in the machine housing and before the maneuvering step, (a) marking the section of flooring starting point, ending point and midpoint at the edge of the curved boundary; (b) determining the optimum distance between the pressure units; (c) calculating the number of said pressure units needed; (d) marking the location where each of the pressure units should be mounted in the machine housing; (e) assembling the pressure units; (f) securing the pressure units between the left and right lateral walls of the machine housing.

7. A method of installing curved hardwood flooring as recited in claim 5, wherein before the activating step, (a) adjusting the relative position of the hardwood flooring slat(s) to each other including correct end joint alignment and alignment with previously installed flooring or structures.

8. A method of installing curved hardwood flooring as recited in claim 5, wherein after the activating step and before the securing step, (a) rechecking and adjusting the relative position of the hardwood flooring slat(s) to each other; whereby rectifying any misalignment of the hardwood flooring slat(s) caused by the activating step, (b) cutting the hardwood flooring slat(s) to ensure that the set of the hardwood flooring slat(s) are even, (c) staggering of each row of the set of said hardwood flooring slats beyond the first row to avoid clustering of ends of adjacent rows in said section of flooring, (d) trimming each row of the set of said hardwood flooring slats) in the last said section of flooring to follow the contour of the adjacent wall or structures.

* * * * *